US008324810B2

(12) United States Patent
Kazakov et al.

(10) Patent No.: US 8,324,810 B2
(45) Date of Patent: Dec. 4, 2012

(54) MULTI-MODE, MULTI-FREQUENCY, TWO-BEAM ACCELERATING DEVICE AND METHOD

(75) Inventors: Sergey Yu Kazakov, Batavia, IL (US); Sergey V. Kuzikov, Nizhny Novgorod (RU); Jay L. Hirshfield, Hamden, CT (US); Vyachesav Yakovlev, Batavia, IL (US); Yong Jiang, New Haven, CT (US)

(73) Assignee: Omega-P, Inc., New Haven, CT (US)

( * ) Notice: Subject to any disclaimer, the term of this patent is extended or adjusted under 35 U.S.C. 154(b) by 294 days.

(21) Appl. No.: 12/692,204

(22) Filed: Jan. 22, 2010

(65) Prior Publication Data

US 2010/0207551 A1 Aug. 19, 2010

Related U.S. Application Data

(60) Provisional application No. 61/146,581, filed on Jan. 22, 2009, provisional application No. 61/297,057, filed on Jan. 21, 2010.

(51) Int. Cl.
*H05H 9/00* (2006.01)
*H05H 25/50* (2006.01)

(52) U.S. Cl. ..... 315/39.51; 315/505

(58) Field of Classification Search ..... 315/5.41, 315/5.43, 39.51, 39.53, 500, 501, 505, 506; 313/359.1, 360.1

See application file for complete search history.

(56) References Cited

U.S. PATENT DOCUMENTS 5,744,919 A * 4/1998 Mishin et al. ..... 315/505
5,821,694 A * 10/1998 Young ..... 315/5.41
6,674,254 B2 * 1/2004 Hanna et al. ..... 315/505
6,844,689 B1 * 1/2005 Brown et al. ..... 315/505

* cited by examiner

*Primary Examiner* — Minh Dieu A
(74) *Attorney, Agent, or Firm* — Arent Fox LLP

(57) ABSTRACT

A two-beam accelerator device including a drive beam source and an accelerated beam source for providing a drive beam and accelerated beam, a detuned resonant cavity disposed in the path of the drive beam and the accelerated beam, and a two-beam focusing device and method of use thereof. The detuned resonant cavity may be rectangular, square, axisymmetrical, and/or cylindrical. The focusing device may include a modified quadrupole magnet having four magnets, a central opening, a channel in the central opening, an opening in one of the four magnets, the opening having a non-magnetic channel lined with a magnetic material.

31 Claims, 31 Drawing Sheets

Acceleration by one harmonic

Acceleration by three harmonics sin(t): $T_{0.95}$ = 20%, $T_{0.9}$ = 29%, $T_{0.8}$ = 41% sin(t)+sin(2t), $T_{0.95}$ = 12%, $T_{0.9}$ = 18%, $T_{0.8}$ = 25% sin(t)+sin(2t)+sin(3t): $T_{0.95}$ = 9%, $T_{0.9}$ = 13%, $T_{0.8}$ = 18% sin(t)+sin(3t): $T_{0.95}$ = 9%, $T_{0.9}$ = 13%, $T_{0.8}$ = 18% sin(t)+sin(3t)+sin(5t): $T_{0.95}$ = 6%, $T_{0.9}$ = 9%, $T_{0.8}$ = 12%

Comparison of exposure time for cases of single and 1+3+5 harmonics

Even Mode

Odd Mode

Electric field in square cavity with three operating harmonics

Magnetic field in square cavity with three operating harmonics

Two-beam accelerator parameters. (a), (b), and (c) show efficiency $\eta$, normalized accelerating gradient seen by test particles $\varepsilon$, and transformer ration T, each as a function of modified current ratio $\zeta$ and normalized detuning $\Delta$: (d) shows $\varepsilon$ as a function of T and $\eta$ .

| $(\Delta\omega/\omega)$ $\times 10^{-3}$ | beam-to-beam efficiency (%) | acceleration gradient (MV/m) | transformer ratio $T$ | peak $E$-field on wall (MV/m) | wall loss (W/cm$^2$) |
|---|---|---|---|---|---|
| 0.5 | 45 | 275 | 9 | 538 | 0.79 |
| 0.6 | 50 | 229 | 10 | 449 | 0.55 |
| 0.7 | 53 | 197 | 11 | 385 | 0.40 |
| 0.8 | 57 | 172 | 12 | 337 | 0.31 |
| **0.9** | **60** | **153** | **13** | **299** | **0.25** |
| 1.0 | 62 | 138 | 13 | 270 | 0.20 |
| 1.1 | 64 | 125 | 13 | 245 | 0.16 |
| 1.2 | 66 | 115 | 14 | 225 | 0.14 |
| 1.3 | 68 | 107 | 14 | 207 | 0.12 |
| 1.4 | 70 | 99 | 15 | 193 | 0.10 |
| 1.5 | 71 | 92 | 15 | 180 | 0.088 |
| 1.6 | 72 | 86 | 15 | 169 | 0.078 |

Parameters for a two-beam electron (or positron) accelerator, as functions of cavity detuning $\Delta\omega/\omega$. In this table, the test beam current $I_t = 4.8\ A$, and for 14 MW average power in each 1.5 TeV beam the duty factor would be about $1.9 \times 10^{-6}$.

FIG. 28

| $\beta$ | proton energy (MeV) | cavity gap (cm) | beam-to-beam eff. (%) | gradient (MV/m) | transformer ratio $\mathcal{T}$ | peak E field (MV/m) | average wall loss ($W/cm^2$) |
|---|---|---|---|---|---|---|---|
| 0.30 | 45.3 | 1.05 | 31 | 91 | 3.26 | 129 | 185 |
| 0.40 | 85.4 | 1.33 | 35 | 95 | 3.68 | 128 | 181 |
| 0.50 | 145.1 | 1.57 | 39 | 98 | 4.10 | 128 | 181 |
| 0.60 | 234.5 | 1.77 | 42 | 100 | 4.42 | 127 | 176 |
| 0.70 | 375.5 | 1.96 | 44 | 101 | 4.62 | 126 | 172 |
| 0.80 | 625.3 | 2.12 | 46 | 101 | 4.83 | 124 | 168 |
| 0.90 | 1,213.9 | 2.27 | 47 | 102 | 4.94 | 123 | 164 |
| 1.0 | - | 2.40 | 49 | 102 | 5.15 | 122 | 160 |

Parameters for a two-beam, one-stage proton accelerator with alternate cavity detunings of $\Delta\omega/\omega = \pm 6 \times 10^{-4}$. With $\mathcal{T} \approx 4.5$, the drive beam energy would be ~225 MeV. With an average acceleration gradient of ~100 MV/m, the active machine length would be ~10 m.

FIG. 29

| $\beta$ | proton energy (MeV) | cavity gap (cm) | beam-to-beam eff. (%) | gradient (MV/m) | transformer ratio $\mathcal{T}$ | peak E field (MV/m) | average wall loss ($W/cm^2$) |
|---|---|---|---|---|---|---|---|
| 0.30 | 45.3 | 1.05 | 51 | 41 | 3.26 | 57 | 33.6 |
| 0.40 | 85.4 | 1.33 | 56 | 42 | 3.68 | 57 | 33.6 |
| 0.50 | 145.1 | 1.57 | 60 | 43 | 4.10 | 56 | 33.6 |
| 0.60 | 234.5 | 1.77 | 63 | 43 | 4.42 | 55 | 33.6 |
| 0.70 | 375.5 | 1.96 | 65 | 44 | 4.62 | 55 | 33.6 |
| 0.80 | 625.3 | 2.12 | 67 | 44 | 4.83 | 54 | 29.4 |
| 0.90 | 1,213.9 | 2.27 | 68 | 44 | 4.94 | 54 | 29.4 |
| 1.0 | - | 2.40 | 69 | 44 | 5.15 | 53 | 29.4 |

. Parameters for a two-beam, one stage proton accelerator with alternate cavity detunings of $\Delta\omega/\omega = \pm 1.4 \times 10^{-3}$. With $\mathcal{T} \approx 4.6$, the drive beam energy would be about 220 MeV. With an average acceleration gradient of about 43 MV/m, the active machine length would be ~ 23 m.

FIG. 30

| $\beta$ | proton energy (MeV) | cavity gap (cm) | beam-to-beam eff. (%) | gradient (MV/m) | transformer ratio $\mathcal{T}$ | peak E field (MV/m) | average wall loss ($W/cm^2$) |
|---|---|---|---|---|---|---|---|
| 0.30 | 45.3 | 1.05 | 69 | 19 | 8.8 | 27 | 7.6 |
| 0.40 | 85.4 | 1.33 | 73 | 20 | 9.1 | 27 | 7.6 |
| 0.50 | 145.1 | 1.57 | 76 | 20 | 9.1 | 26 | 7.1 |
| 0.60 | 234.5 | 1.77 | 78 | 20 | 9.1 | 26 | 7.1 |
| 0.70 | 375.5 | 1.96 | 80 | 21 | 9.0 | 26 | 7.1 |
| 0.80 | 625.3 | 2.12 | 81 | 21 | 8.9 | 25 | 6.7 |
| 0.90 | 1,213.9 | 2.27 | 82 | 21 | 8.8 | 25 | 6.7 |
| 1.0 | - | 2.40 | 83 | 21 | 8.7 | 25 | 6.7 |

Parameters for a two-beam one stage proton accelerator with alternate cavity detunings of $\Delta\omega/\omega = \pm 3.0 \times 10^{-3}$. With $\mathcal{T} \approx 9.0$, the drive beam energy would be about 110 MeV. With an average acceleration gradient of about 20 MV/m, the active machine length would be ~ 50 m.

FIG. 31

MULTI-MODE, MULTI-FREQUENCY, TWO-BEAM ACCELERATING DEVICE AND METHOD

CLAIM OF PRIORITY UNDER 35 U.S.C. §119

The present application for patent claims priority to Provisional Application No. 61/146,581 entitled "MULTI-MODE, MULTI-FREQUENCY, TWO-BEAM ACCELERATING STRUCTURE" filed Jan. 22, 2009, and to Provisional Application No. 61/297,057 entitled "HIGH GRADIENT TWO-BEAM ACCELERATOR STRUCTURE" filed Jan. 21, 2010, the entire contents of both which are hereby expressly incorporated by reference herein.

BACKGROUND

Particle accelerators assist in research providing significant fundamental scientific information beyond that currently available. Particle accelerators also have application in medical therapy and nuclear energy. In addition to the Large Hadron Collider (LHC), the Compact Linear Collider (CLIC) has been proposed at CERN (European Organization for Nuclear Research). CLIC uses different technology than the LHC to achieve a higher planned energy of several TeV. Conventional linear accelerators use a radio-frequency (RF) power to accelerate a main beam generated by devices called klystrons. This creates RF waves. However, klystrons use a large amount of power at high frequencies, and a conventional machine would require many of them in order to reach 3 TeV.

Instead, the CLIC proposal includes the use of two-beam acceleration, involving coupled RF cavities that transfer energy from a high-current, low-energy drive beam to a low-current, high energy accelerated beam to be used for colliding beams of positrons and electrons. Thus, the high-intensity, low-energy drive beam runs parallel to the main linear accelerator beams, and power that is built up in the drive beams can then be transferred in quick bursts to the accelerator beams. This is done by decelerating the drive beam in special power extraction structures (PETS) and the generated RF power is then transferred to the main beam. This allows for a simple tunnel layout with both the drive beam and accelerator beam being generated in a central injector complex and being transported along the linac.

It is hoped that such a design will allow acceleration to reach significantly higher energies (3 to 5 TeV) in a shorter length machine than the more conventional acceleration cavities of the International Linear Collider (ILC) design. FIGS. 1 and 2 illustrate aspects of the CLIC design. Additional information regarding CLIC can be found at http://clic-study.web.cern.ch/CLIC-Study/ and http://preprints.cern.ch/yellow-rep/2000/2000-008/p1.pdf, the entire contents of both of which are incorporated herein by reference.

Although the proposed CLIC design simplifies the tunnel layout, such high energy can cause damage in the metal cavities surrounding the beams. The proposed design is prone to breakdown for accelerating fields exceeding 100 MV/m, where electrons and atoms are pulled from the surrounding metal cavity as the electric field becomes high, thereby causing degradation to the accelerator components. Further, the CLIC design is very complex and requires a number of complicated components, such as the PETS and additional transfer structures.

Thus, a need exists in the art for particle accelerators that allow accelerator fields to be sustained at high levels without causing breakdown or degradation of the accelerator cavity or surrounding accelerator structure.

SUMMARY

Aspects in accordance with the present invention meet the need in the art by providing an accelerator structure and method that enable high electric fields to be used without degradation of the accelerator components. The breakdown limit is increased by decreasing the exposure time due to high electric fields by passing a drive beam and an accelerator beam through a resonant cavity having a single or multiple modes. A desirable transformer ratio can be achieved via detuning in connection with a resonant cavity. Aspects include an RF cavity structure for a two-beam accelerator having cavities that are excited by a drive beam in several harmonically-related modes that are detuned from resonance to allow achievement of a high transformer ratio. The cavity fields may be symmetric with respect to the paths of the drive beam and the accelerated beam.

Aspects in accordance with the present invention also meet the need in the art by providing a modified quadrupole magnet that enables focusing of the beams in a two-beam accelerator Aspects may include a two-beam accelerator device comprising: a drive beam source for providing a drive beam; an accelerated beam source for providing a accelerated beam parallel to the drive beam; and a detuned, harmonic cavity disposed in the path of the drive beam and the accelerated beam, the surfaces of the cavity perpendicular to a path of the drive beam and the accelerated beam having at least one opening at the entrance and exit locations where the drive beam and the accelerated beam, respectively pass through the surfaces.

Aspects may further include the detuned cavity being an axisymmetric cavity and the drive beam and accelerated beam are co-linear, the cavity having one opening at each side of the cavity in the surfaces perpendicular to the path of the drive beam and the accelerated beam.

Aspects may further include the detuned cavity having a modified pill box shape with planar walls having a sinusoidal profile.

Aspects may further include the cavity being a six sided resonant cavity, the surfaces of the cavity perpendicular to a path of the drive beam and the accelerated beam being rectangular and having a first and a second opening at the location where the drive beam and the accelerated beam, respectively intersect the surfaces, wherein the centers of the first and second openings are spaced a distance 2d from each other in a width direction, wherein d is ¼ the width of the surfaces, and a distance d from the closest side wall in a length direction and are equally spaced between the side walls in a height direction.

Aspects may further include the drive beam having a drive beam voltage 90° out of phase with a drive beam current, and the accelerated beam having an accelerated beam current in phase with the drive beam current and an accelerated beam voltage 180° out of phase with the drive beam voltage.

Aspects may further include the length and width of the surfaces of the resonant cavity perpendicular to the path of the drive beam and the accelerated beam having a ratio of 2:1, 2.582:1, or 2:1.291; the resonant cavity comprising walls having a width between 2-4 mm; and the resonant cavity comprising a metal, such as copper, and the dimension of the cavity that is parallel to the direction of travel of the two beams minimizing $I_2$ and $I_3$, where G is an acceleration gradient for the resonant cavity, E is the peak electric field for the resonant cavity, t is time, and T is the effective pulse width, wherein $$I_2 = \int_0^T E^2\,dt/G^2T$$

and wherein $$I_3 = \int_0^T E^3\,dt/G^3T.$$

The two-beam accelerator device may further include a set of cavities including a plurality of adjacent resonant cavities. Each of the resonant cavities may comprise multiple pieces and an external device surrounding the set of resonant cavities for holding the pieces of each cavity together to form the cavity and for maintaining the position of the resonant cavities with respect to one another and/or a pumping manifold surrounding the external device.

The two-beam accelerator device may include a drive beam that travels in the same direction as the accelerated beam or a drive beam that travels in a direction opposite from the direction of the accelerated beam.

The two-beam accelerator device may further include a focusing device such as a modified quadrupole magnet having four magnets, a central passage in the center of the four magnets, and an opening in one of the magnets, wherein the opening includes a channel lined with a magnetic material.

Aspects may further include a method of accelerating a particle beam, the method comprising: providing a drive beam; providing a accelerated beam parallel to the drive beam; and passing the drive beam and the accelerated beam through a detuned, harmonic cavity disposed in the path of the drive beam and the accelerated beam, the surfaces of the cavity perpendicular to a path of the drive beam and the accelerated beam having at least one opening on each side of the cavity at the locations where the drive beam and the accelerated beam, respectively pass through the surfaces.

Aspects may further include the detuned cavity being an axisymmetric cavity and the drive beam and accelerated beam are co-linear, the cavity having one opening at each side of the cavity in the surfaces perpendicular to the path of the drive beam and the accelerated beam.

Aspects may further include the detuned cavity having a modified pill box shape with planar walls having a sinusoidal profile.

Aspects may further include the cavity being a six sided resonant cavity disposed in the path of the drive beam and the accelerated beam, the surfaces of the cavity perpendicular to a path of the drive beam and the accelerated beam being rectangular and having a first and a second opening at the location where the drive beam and the accelerated beam, respectively pass through openings in the surfaces, wherein the centers of the first and second openings are spaced a distance 2d from each other in a width direction, wherein d is ¼ the width of the surfaces, and a distance d from the closest side wall in a width direction and are equally spaced between the side walls in a height direction.

Aspects may further include the drive beam having a drive beam voltage 90° out of phase with a drive beam current, and the accelerated beam having an accelerated beam current in phase with the drive beam current and an accelerated beam voltage 180° out of phase with the drive beam voltage.

Aspects may further include the length and width of the surfaces of the resonant cavity perpendicular to the path of the drive beam and the accelerated beam having a ratio of 2:1, 2.582:1, or 2:1.291; the resonant cavity comprising walls having a width between 2-4 mm; and the resonant cavity comprising a metal, such as copper, and the dimension of the cavity that is parallel to the direction of travel of the two beams minimizing $I_2$ and $I_3$, where G is an acceleration gradient for the resonant cavity, E is the peak electric field for the resonant cavity, t is time, and T is the effective pulse width, wherein $$I_2 = \int_0^T E^2\,dt/G^2T$$

and wherein $$I_3 = \int_0^T E^3\,dt/G^3T.$$

Aspects may further include passing the drive beam and the accelerated beam through cavity set comprising a plurality of resonant cavities disposed adjacent to one another; passing the drive beam and accelerated beam through a focusing device, such as a modified quadrupole magnet having an opening in one of four magnets, the opening including a channel lined with a magnetic material, the method further comprising passing one of the drive beam and the accelerated beam through the center of the quadrupole magnet and passing the other of the drive beam and the accelerated beam through the lined channel in the opening in the magnet; and/or passing the drive beam and the accelerated beam through a second focusing device, such as a second modified quadrupole magnet having an opening in one of its four magnets, the opening including a second channel lined with a magnetic material, the method further comprising: passing the other of the drive beam and the accelerated beam through the center of the second quadrupole magnet and passing the drive beam or the accelerated beam through the second lined channel in the opening in the magnet of the second modified quadrupole magnet.

Aspects may further include reducing a fill time by driving a pre-pulse drive beam current being phase locked with the drive beam and/or by modifying at least one of the amplitude and the phase of a beam profile for the drive beam.

The method may include driving the drive beam and the accelerated beam in the same direction or driving the drive beam and the accelerated beam in opposite directions.

Aspects may further include a focusing apparatus for a two-beam particle accelerator having a first and a second particle beam, comprising: a modified quadrupole magnet, the modified quadrupole magnet including: four magnets; a central opening; a channel in the central opening configured to pass the first particle beam; a non-magnetic material surrounding the channel; an opening in one of the four magnets; a second channel in the opening in the magnet configured to pass the second particle beam; a non-magnetic material surrounding the second channel; and a magnetic material lining the interior of the non-magnetic material in the second channel.

The focusing apparatus may further comprise a second and a third modified quadrupole magnet in series with the first modified quadrupole magnet, each of the first, second, and third quadrupole magnets being positioned such that the first particle beam passes through the channel in the central opening and the second particle beam passes through a channel within one of the four magnets of the first, second, and third modified quadrupole magnets.

The focusing apparatus may further comprise a fourth, fifth, and sixth modified quadrupole magnet in series with the first, second, and third quadrupole magnet, wherein the fourth, fifth, and sixth quadrupole magnets are positioned such that the second particle beam passes through the channel in the central opening and the first particle beam passes through a channel within one of the four magnets of the fourth, fifth, and sixth modified quadrupole magnets.

Aspects may further include a method of focusing the beams of a two-beam particle accelerator having a first and a second particle beam, the method comprising: providing a first modified quadrupole magnet, the modified quadrupole magnet including four magnets; a central opening; a channel in the central opening; a non-magnetic material surrounding the channel; an opening in one of the four magnets; a second channel in the opening in the magnet; a non-magnetic material surrounding the second channel; and a magnetic material lining the interior of the non-magnetic material in the second channel; and simultaneously passing the first particle beam through the channel in the central opening and passing a second particle beam through the second channel, in the first modified quadrupole magnet.

The method may further include providing a second and a third modified quadrupole magnet in series with the first modified quadrupole magnet; and passing the first particle beam through the channel in the central opening in the second and the third modified quadrupole magnet; and passing the second particle beam through the second channel in the second and third modified quadrupole magnets.

The method may further include providing a fourth, fifth, and sixth modified quadrupole magnet in series with the first, second, and third modified quadrupole magnets; passing the second particle beam through the channel in the central opening of the fourth, fifth, and sixth magnets; and passing the first particle beam through the second channel in the fourth, fifth, and sixth modified quadrupole magnets To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which:

FIG. 28 illustrates exemplary parameters for an illustration of an electron accelerator in accordance with aspects of the present invention.

FIGS. 29-31 illustrate exemplary parameters for illustrations of a proton accelerator in accordance with aspects of the present invention.

DETAILED DESCRIPTION

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

As noted above, problems associated with breakdown that limit the accelerating gradient are a major factor in particle accelerators. The probability of breakdown depends both on the field strength to which the accelerator components are subjected and on the exposure time to that peak field. Lower exposure times to peak magnetic fields are likely to cause reduced pulse heating at the cavity surface, thereby reducing breakdown and degradation of the accelerator components.

In order to avoid such degradation a single or multi-mode acceleration cavity can be incorporated into a detuned accelerator structure such that the accelerating fields that accelerate the particles can be made in a manner that allows them to be strong only when necessary and to be weaker at other times. Thus, the cavities may be excited in several harmonically-related eigenmodes, such that the RF fields reach their peak values only during small portions of each basic RF period. Aspects in accordance with the present invention can be used for the acceleration of, among others, beams of electrons, positrons, muons, protons, heavier ions. This may help raise the thresholds for both breakdown and pulse heating. Additionally, no transfer elements are needed to couple RF energy from the drive beam to the accelerated beam, because both beams traverse the same cavities.

Figure 1:
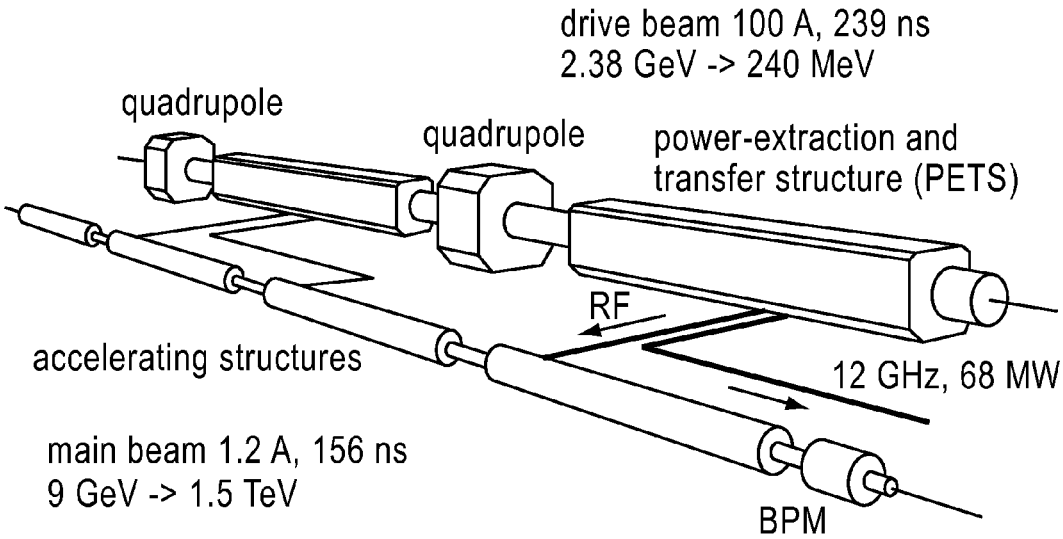
FIG. 1 PRIOR ART
FIGS. 1 and 2 illustrate aspects of the CLIC accelerator.
Figure 2:
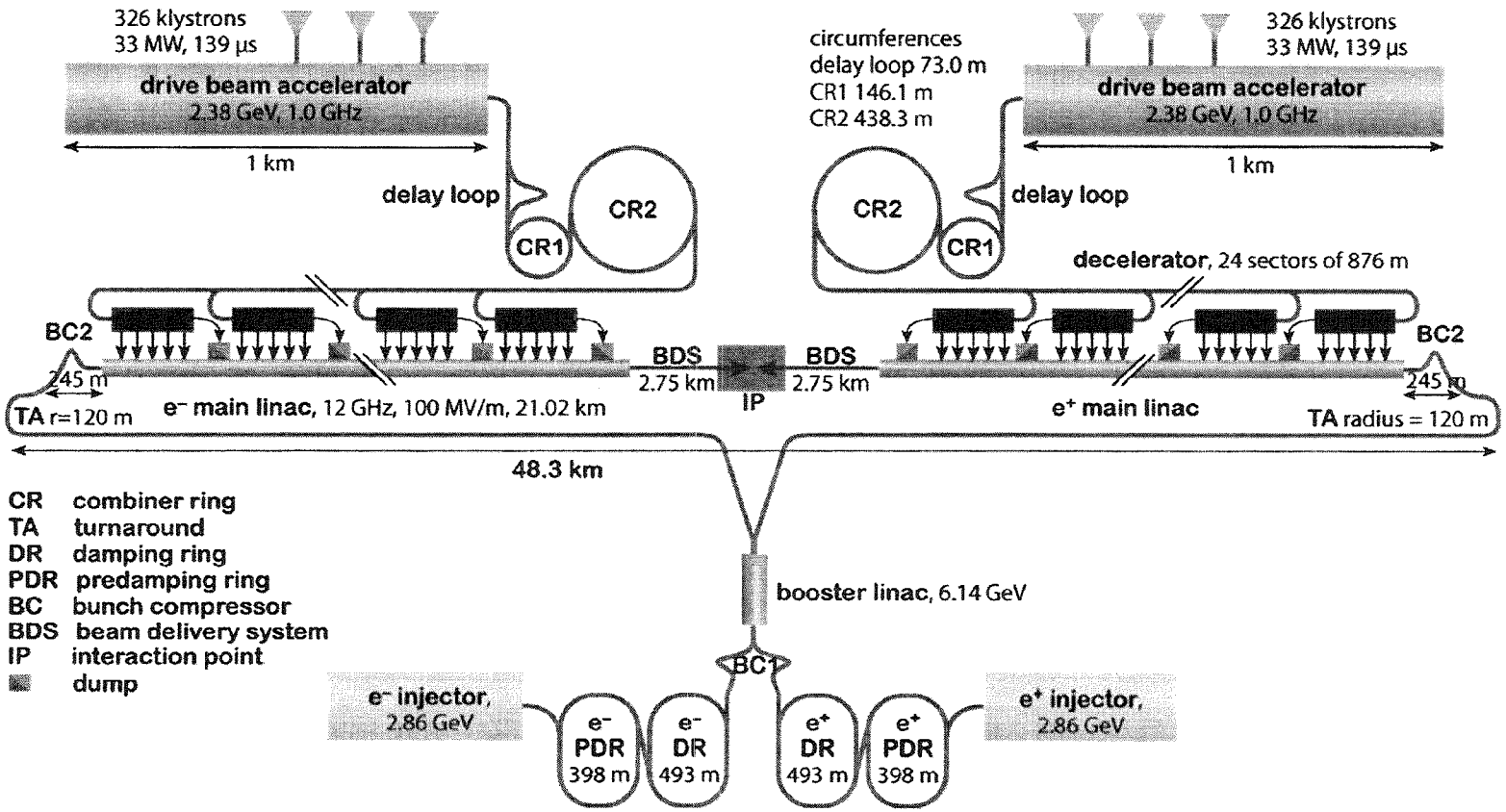
FIG. 2 PRIOR ART
Figure 3A:
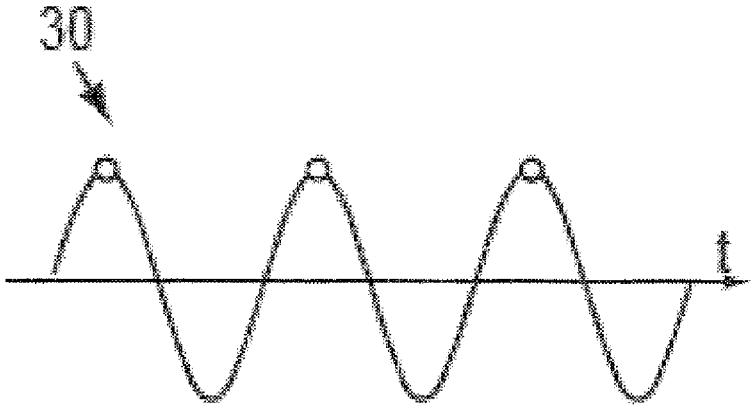
FIGS. 3*a* and 3*b* illustrate a single harmonic and three mode harmonic patterns for electric fields in accordance with aspects of the present invention.
Figure 3B:
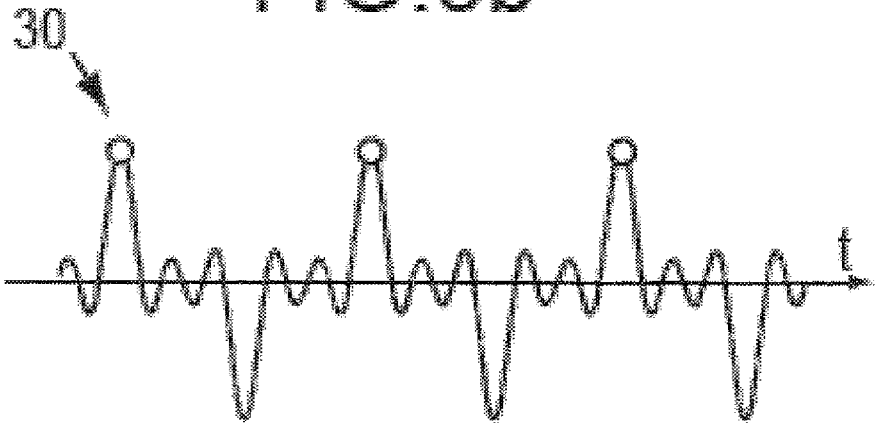

FIG. 3 illustrates a single sine wave harmonic pattern, where the RF energy is concentrated on the particle bunch only for short amounts of time during the transit of the particle bunch through the cavities. The harmonic energy wave reaches a maximum 30 at the position necessary to interact with the particle bunch. FIG. 3*b* illustrates an RF energy pattern for acceleration using three harmonics.

Figure 4A:
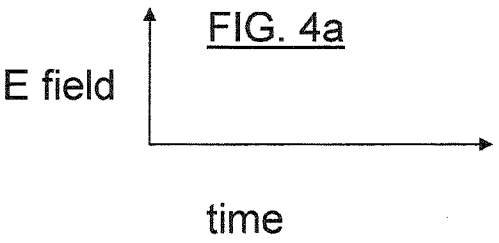
FIGS. 4*a-f* illustrate harmonic patterns for electric fields in accordance with aspects of the present invention.
Figure 4B:
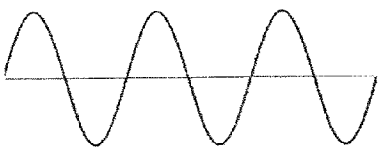
Figure 4C:
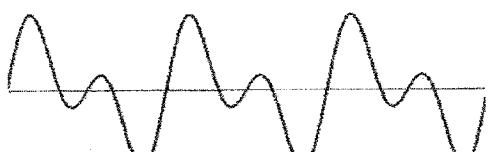

FIGS. 4*b*-4*f* illustrate the reduced amount of exposure time when multiple harmonics are superimposed. FIG. 4*a* illustrates that the horizontal axis represents time and the vertical axis represents the strength of the electric field for each of FIGS. 4*b*-4*f*. For example, FIG. 4*b* illustrates the amount of exposure to the field for a single harmonic. For each of the curves, the percentage of exposure time is listed for exposure to 95%, 90%, and 80% of the strongest field. Thus, $T_{0.95}$ is the percentage of exposure time to 95% of the strongest field, $T_{0.90}$ is the percentage of exposure time to 90% of the strongest field, and $T_{0.80}$ is the percentage of exposure time to 80% of the strongest field.

Figure 4D:
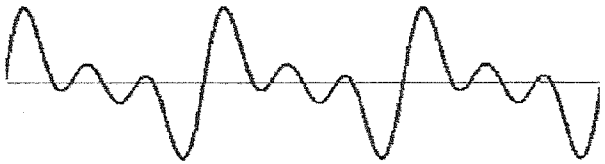
Figure 4E:
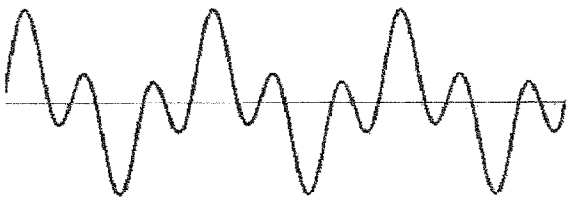
Figure 4F:
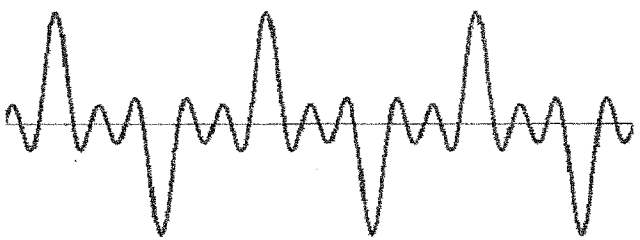

FIGS. 3*c* and 3*e* illustrate examples using various dual harmonic designs. FIGS. 4*d* and 4*f* illustrate examples using a superposition of three harmonics. The exposure time to electric fields that are 95% of the strongest field is reduced to 6% from 20% for a single harmonic. Likewise the exposure to 90% of the strongest field is reduced to 9% from 29%, and exposure to 80% of the strongest field is reduced to 12% from 41% for the single harmonic design. Therefore, by superimposing multiple harmonics, such as the three illustrated in FIG. 4*f*, the amount of exposure time to strong fields can be drastically reduced.

Figure 5:
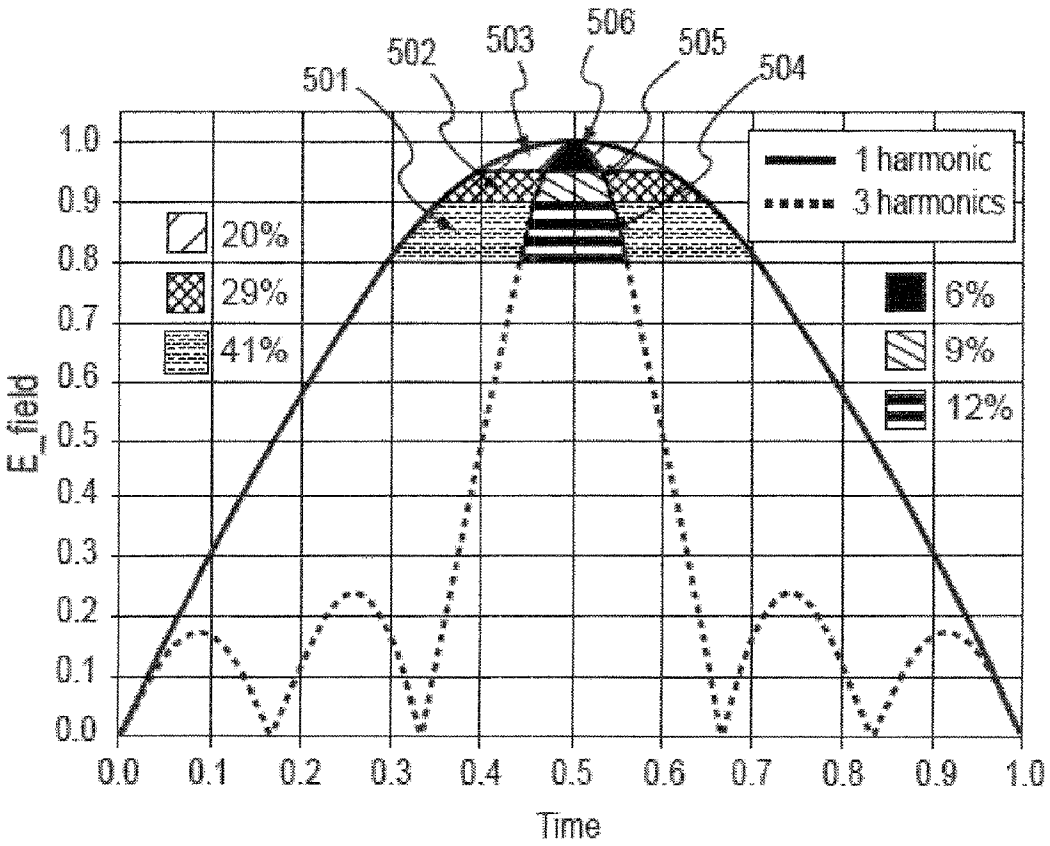
FIG. 5 illustrates the reduction in exposure time to peak fields in accordance with aspects of the present invention.

FIG. 5 illustrates a graph showing the amount of exposure for both the single harmonic design from FIG. 4*b* and the triple harmonic design from FIG. 4*f*. The first shaded regions 501, 502, and 503 illustrate the amount of exposure at 95% or more, 90% or more, and 80% or more of the strongest field, respectively, for the single harmonic design.

Regions 504, 505, and 506 similarly illustrate the amount of exposure at 95% or more, 90% or more, and 80% or more of the strongest field, respectively, for the triple harmonic design.

Thus, these graphs illustrate that a multiple harmonic in the electric field energy would beneficially reduce the amount of exposure, thereby assisting the use of higher fields without the drawback of breakdown.

Figure 6B:
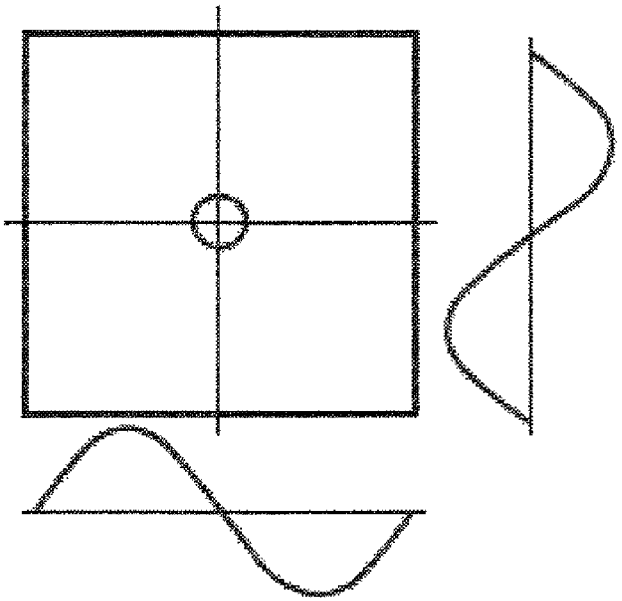
FIGS. 6*a* and 6*b* illustrate an even and odd harmonic mode in a square cavity in accordance with aspects of the present invention.
Figure 6A:
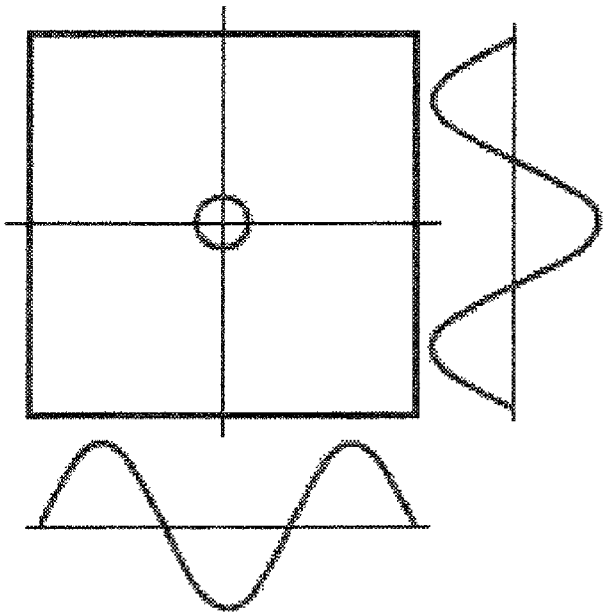

In order to have a multi-mode cavity, the cavity must have a harmonic spectrum. The modes need to be spaced from one another with an equal frequency interval to make the interference process periodic. The simplest cavity with this kind of spectrum is a square box cavity of side length $\alpha$ operating in a $TM_{ii0}$ mode, for which eigenfrequencies are given by $f_{ii0}=ic/\sqrt{2}a$. The frequency separation between these modes is given by $f_{110}=c/\sqrt{2}a$, the eigenfrequency for the lowest such mode. Modes with even i have zero electric field on axis and thus would not interact with a beam on axis. The modes which interact with the beam have frequencies f, 3f, 5f, . . . , etc. FIGS. 6*a* and 6*b* illustrate odd and even modes for a square box cavity.

Figure 7:
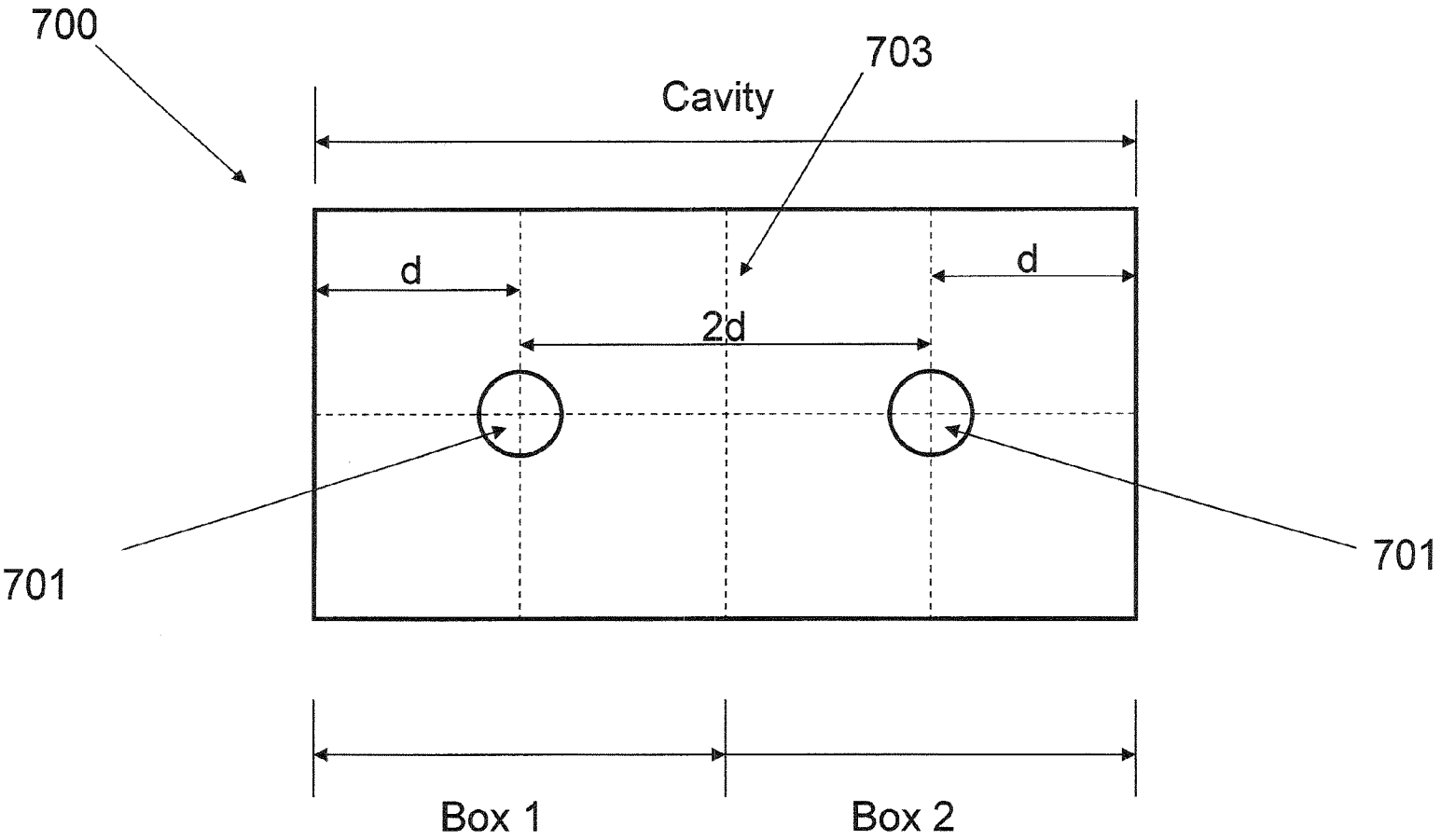
FIG. 7 illustrates an exemplary cavity in accordance with aspects of the present invention.

One exemplary implementation employing a rectangular or square cavity, also referred to interchangeably herein as a two-box cavity, a two-cell cavity, and a dual-box cavity, and a resonant cavity comprises a six-sided cavity that is structured as two boxes placed together with the common wall removed. Thus, the cavity may be a six-sided box-type cavity having the outer dimensions of two boxes placed together. The cavity is placed in a two-beam accelerator along the path of a drive beam and an accelerated beam. The surfaces of the box perpendicular to the beam paths include openings for the drive beam channel and the accelerated beam channel. FIG. 7 shows a surface of the cavity 700 having openings 701. The dotted lines show that the cavity 700 consists of two boxes, shown with a dashed line, an opening 701 for a beam channel positioned at the center of each box, and the common wall 702 removed, also shown with a dashed. The other surfaces of the cavity are substantially solid. Each beam channel is positioned to pass through the center of one of the respective "boxes" that form the cavity.

Therefore, as shown in FIG. 7, in a length direction, each beam opening will be spaced an amount d from the nearest wall, and a distance 2d from the other beam. In other words, the distance from the walls will be d and 3d in a length direction. The beam openings have an equal distance from the walls in a width direction.

A vacuum pump and focusing optics may be included in a two-beam accelerator according to aspects of the present invention, but there is no need for external sources of microwaves, for external RF sources, or for transfer structures between the drive and the accelerator channels. The cavity is structured such that passing the detuned drive beam and accelerated beam through the cavity energizes the accelerated beam.

Figure 8:
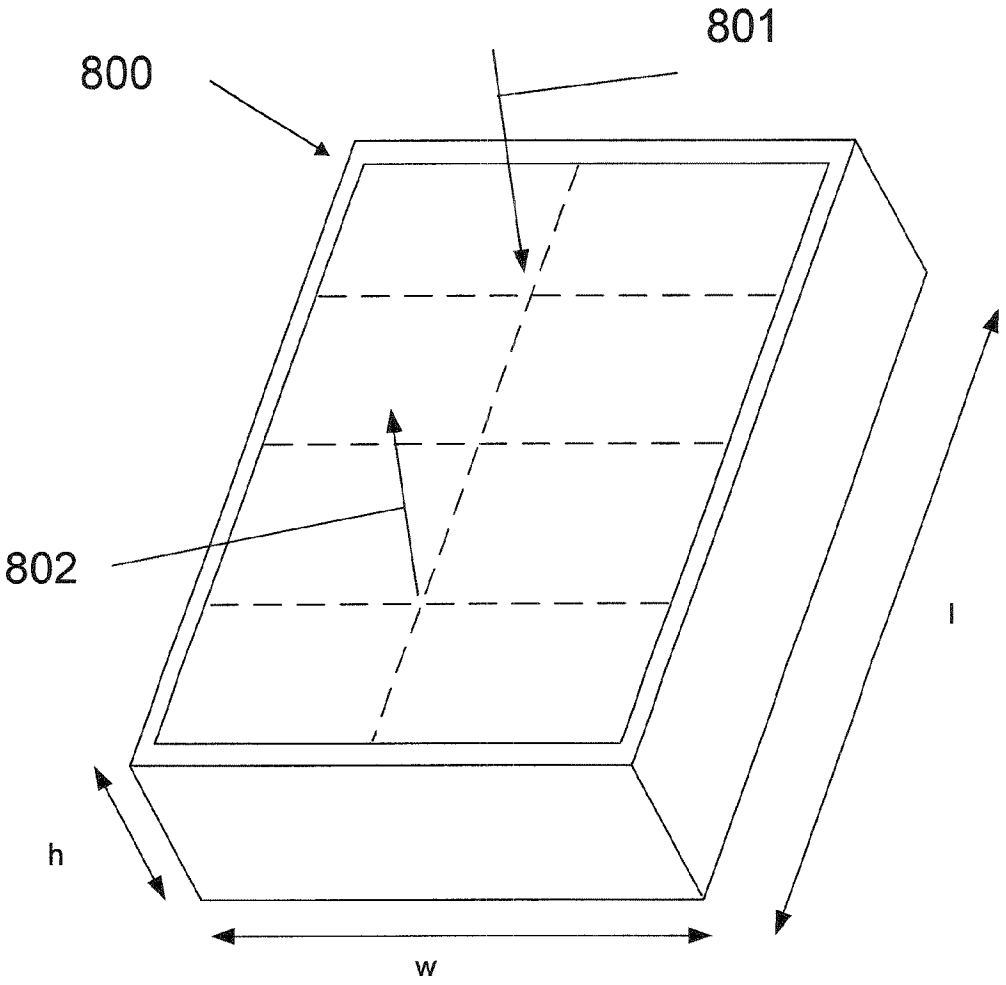
FIG. 8 illustrates a cross-section of an exemplary cavity in accordance with aspects of the present invention.

The transverse dimensions of the cavity, the length l and width w, as illustrated in FIG. 8, control the frequency of the mode. In one exemplary illustration, the length may be 141.324 mm and the width may be 70.662 mm. It is noted that in certain exemplary implementations, the length may be double the width, and the width may be as long as one side of a square box, while the length incorporates the length of two square boxes, as discussed above in connection with FIG. 7. Thus, other transverse dimensions for a cavity may be used having a ratio of 2:1 for the length:width ratio of the cavity. In the illustration in FIG. 8, the beams would travel through the cavity at a distance of approximately 7 cm from each other. Although the arrows indicate that the drive beam and the accelerated beam are driven in opposite directions, they may also be driven in the same direction.

Another exemplary implementation may include an axisymmetric or cylindrical cavity, such as the modified pill box cavity discussed in further detail below. Boxes may be difficult to build, requiring extensive machining, whereas cylinders can be more easily constructed, such as using a lathe, where they can be turned smoothly and quickly. Cylindrical cavities also avoid undesirable sharp corners. While the spectrum of modes may not be easy to establish with non-rectangular cavities, an exemplary illustration is discussed in further detail with regard to the modified pill box cavity.

The gap width for the cavity is shown as h in FIG. 8. Although the gap width h does not determine the frequency of the mode, the gap is the distance through which the particles in the drive beam and acceleration beam will travel as they pass through the cavity. The optimal gap width will vary according to the number of modes employed in the cavity. For example, for a cavity having a length 141.324 mm and a width of 70.662 mm, with a wall thickness of 3 mm, the resonant frequency of $TM_{1,2,0}$ mode is fixed at 3 GHz, but the drive bunch frequency and the mode frequencies $TM_{3,6,0}$, $TM_{5,10,0}$, $TM_{1,14,0}$, and $TM_{7,2,0}$ are varied. In this illustration, the optimal h is 25 mm for the single mode case f, 15 mm for the two mode case f, 3f and 10 mm for the three mode case f, 3f, 5f This occurs because for higher frequencies, the length of time that the particles spend in the gap has to be compared with the RF period. If the length of time is comparable to the RF period, a loss in acceleration occurs because the fields are changing while the particles are in the gap. Therefore, when higher frequencies are used, it is beneficial to use a narrower gap. However, if the gap is narrower, the energy gain from traversing the cavity is less. Therefore, additional cavities are necessary in order to obtain the same acceleration with the narrower cavities. The particle needs to pass through the gap in a time shorter than half a period of oscillation, or half a wavelength.

A single mode accelerator having single mode cavities can be simple to produce because it would employ larger cavity gaps and would require fewer cavities. Whereas, as discussed above, multiple mode cavities have lower exposure times than a single mode cavity.

Wall Thickness

Figure 9:
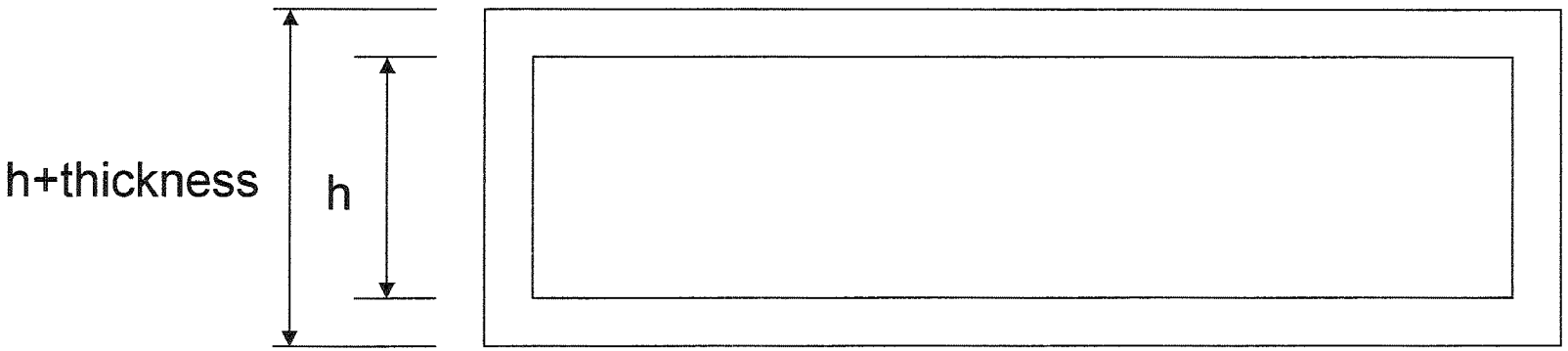
FIG. 9 illustrates a cross-section of an exemplary cavity in accordance with aspects of the present invention.

FIG. 9 illustrates the thickness of the walls of the cavity. Heat will be generated in the cavities as the two beams pass through the openings in the cavities. The thickness of the cavity walls should be selected so that the wall is capable of transmitting heat to the perimeter of the cavity walls where it can be removed. Among others, the thickness of the walls may fall within the range 2-4 mm, for example, 3 mm. If the walls were much less than a millimeter thick, the walls would likely be too thin and weak. On the other hand, a wall thickness much beyond 4 mm begins to waste space in the accelerator. Thus, the thickness is selected to balance the practical needs for structural strength, an efficient use of space, and the ability to transfer heat to the perimeter of the cavity.

Detuning

Figure 10:
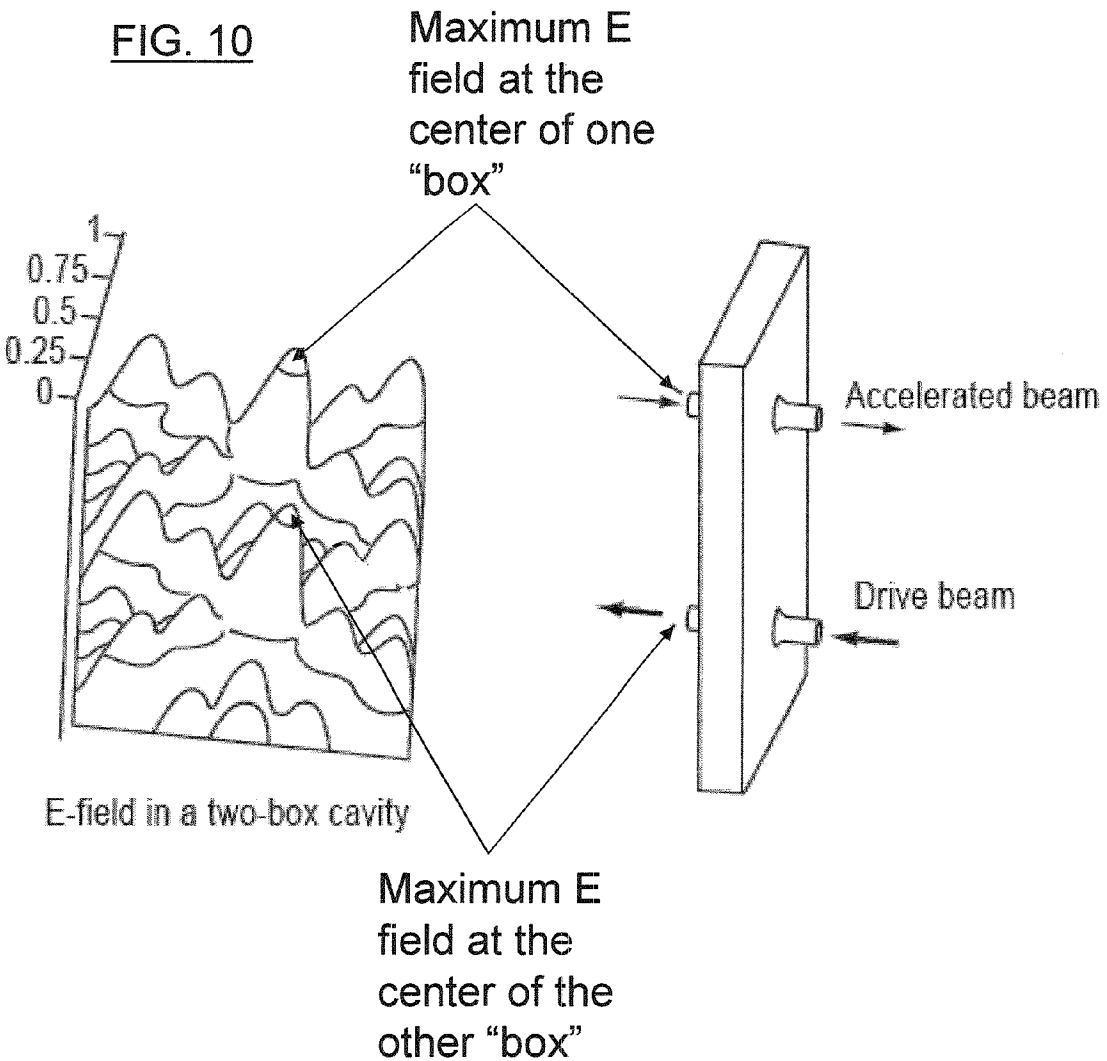
FIG. 10 illustrates the placement of the accelerated beam and the drive beam in relation to the peak electric fields for an exemplary cavity in accordance with aspects of the present invention.

In an accelerator employing a cavity having, for example, a 2:1 transverse ratio, several harmonically-related modes can be excited in the cavity by driving a drive beam with a bunch frequency, such as $f_{110}$ illustrated in FIG. 10. The two box cavity enjoys the required property of an equidistant set of modes.

Figure 11:
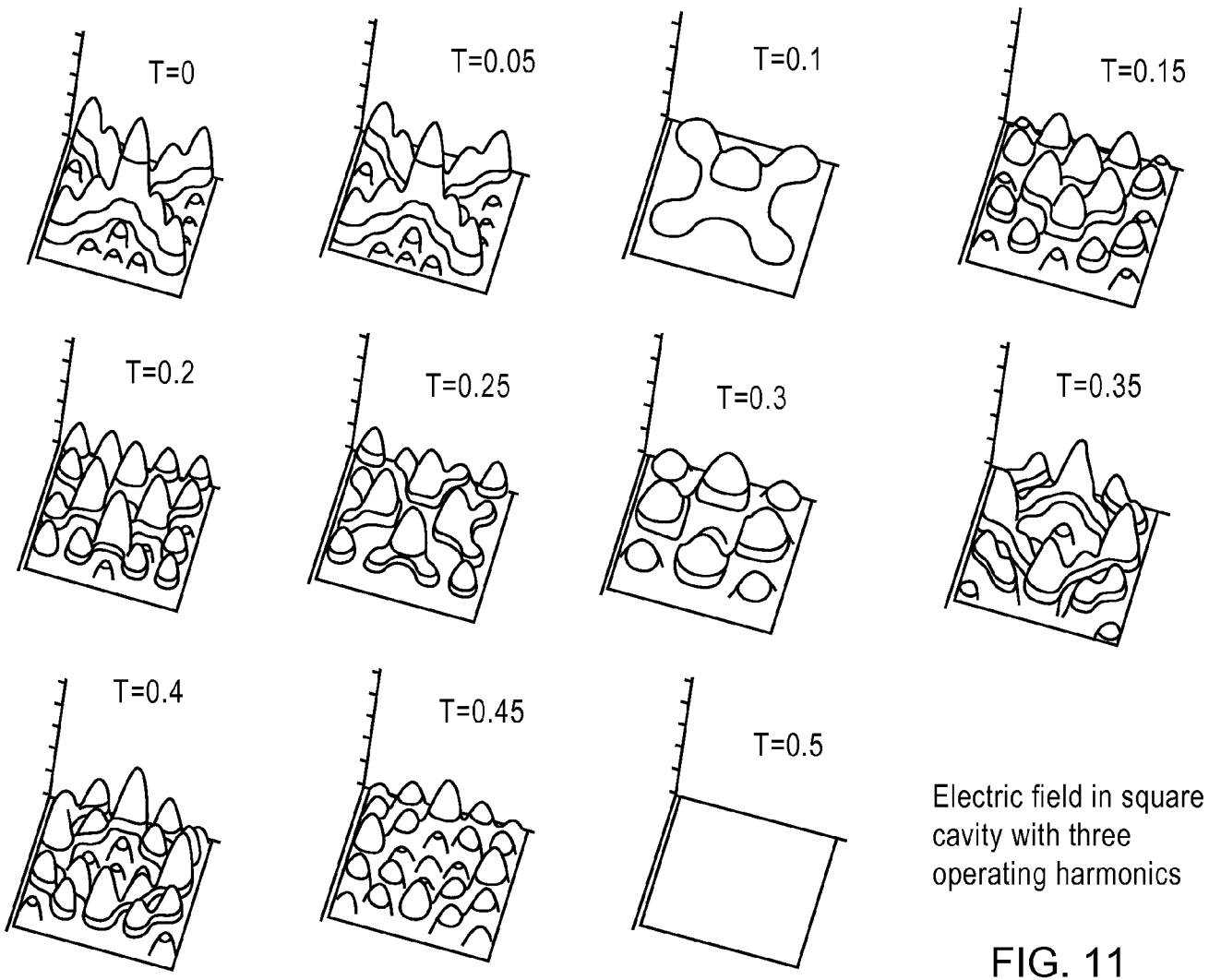
FIG. 11 illustrates exemplary electric fields within an exemplary cavity in accordance with aspects of the present invention.
Figure 12:
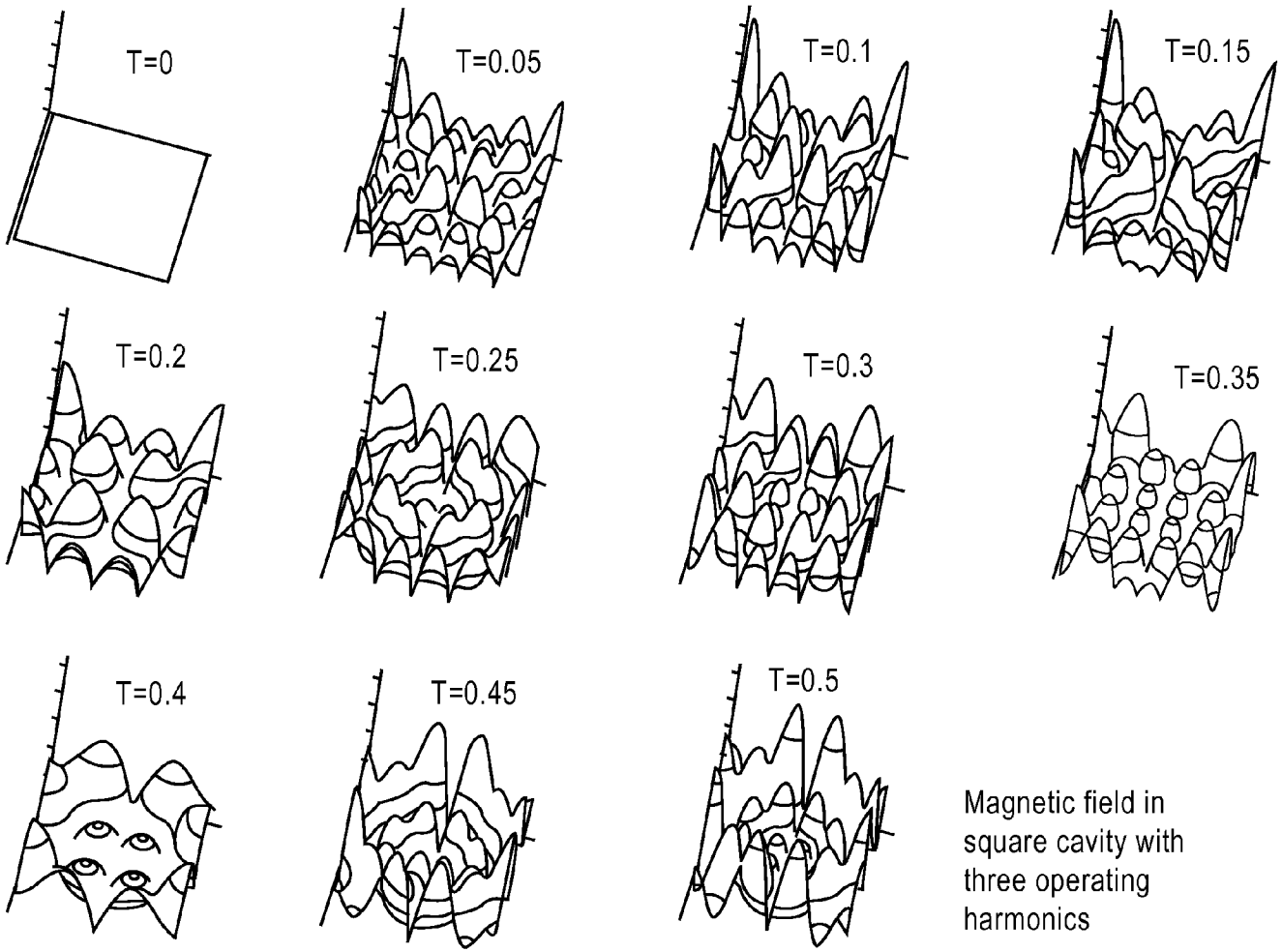
FIG. 12 illustrates exemplary magnetic fields within an exemplary cavity in accordance with aspects of the present invention.

FIGS. 11 and 12 illustrate the electric and magnetic fields, respectively, present in a square cavity with three harmonics. In these figures, T represents time. Thus, FIG. 11 shows that, at T=0, the electric field has a peak in the center of the cavity. By T=0.3, the peak is gone. FIG. 12 shows the magnetic field in the square cavity with three operating harmonics. There is no magnetic field at T=0, however, by T=0.5, the magnetic field reaches a high level around the perimeter of the cavity. The magnetic field in FIG. 12 is out of phase with the electric field in FIG. 11. These figures illustrate how quickly the electric field collapses.

At the center of each box, the operating modes reach a maximum electric field while having zero magnetic field. Thus, the center of each "box" in the resonant cavity appears to be the ideal place for the drive beam and the accelerated beam. However, the electric fields in the accelerating channel and the drive channel are equal. Thus, the transformer ratio would be at most, unity, rendering the structure essentially useless as an accelerator.

Although it appears that it would be unprofitable to choose these locations for the beams, because both channels would have the same electric field resulting in an accelerating gradient of 1, the transformer ratio can be significantly increased by detuning the cavity.

Figure 13B:
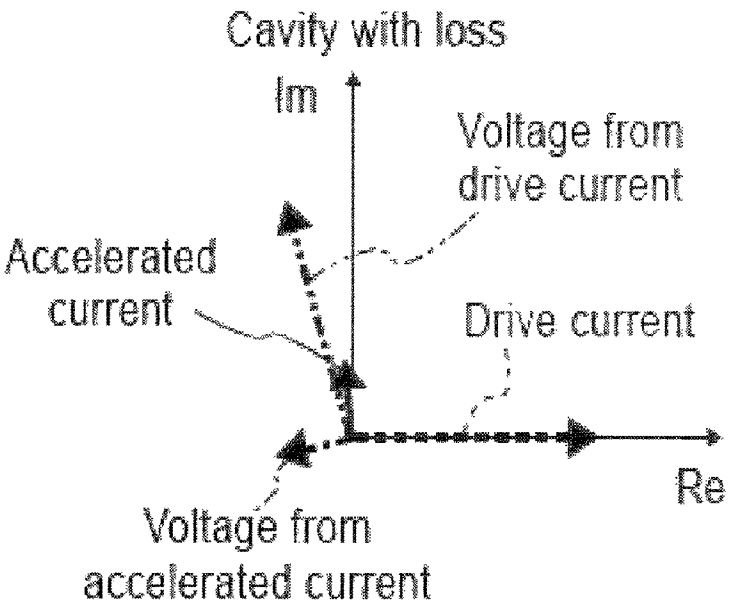
FIGS. 13*a* and 13*b* illustrate detuning for a cavity without loss and a cavity with loss in accordance with aspects of the present invention.
Figure 13A:
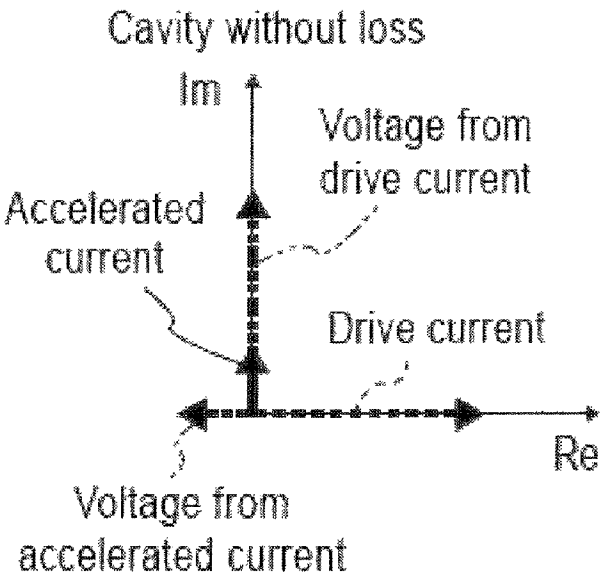

FIG. 13*a* illustrates the operation of a detuned cavity without loss, and a detuned cavity with loss is illustrated in FIG. 13*b*. In an ideal resonant circuit, the voltage and current are in phase with one another. If you move off of resonance, such as in a detuned cavity, when there is no loss, the current and voltage for the drive and acceleration beam are 90° out of phase. Thus, the electric field peak in the cavity occurs one quarter period after passage of the drive current bunch. Whether the voltage is ahead or behind the current depends on whether the frequency is changed to be higher than or lower than the resonant frequency. An accelerated particle bunch can be phased to arrive at an arbitrary time. Thus, the drive beam voltage and accelerated beam current can be in phase (so that work is done on the accelerated beam particles by the drive beam) while the accelerated beam voltage and the drive beam current are 180° out of phase (and work is done by the accelerated beam on the drive beam particles). This leads to energy gain by the accelerated beam equal to an energy loss by the drive beam, with a transformer ratio $\chi$ equal to the ratio of currents $\alpha$, i.e., $\chi=\alpha=I_D/I_A$, where $I_D$ is the drive beam current and $I_A$ is the accelerated beam current FIG. 13*a* shows detuning, where the voltage points vertically for the drive beam while the current points horizontally. Thus, the voltage and current are out of phase. If the accelerated beam is injected at a certain time, the accelerated current is in phase with the drive current while the voltage from the accelerated beam is 180° out of phase with the drive current. In this situation, the field experienced by the drive beam is very weak, zero in the ideal case. Thus, the drive beam, or the strong high current beam is hardly decelerated, whereas the accelerated beam arriving 90° later experiences a very strong voltage because it has entered the cavity at a time when the voltage from the drive beam is highest at its location. The weak current of the accelerated beam adds some of its voltage to the drive beam, but not very much.

However, every real world cavity experiences loss, thus, the phase angle is slightly off resonance, as illustrated in FIG. 13*b*. This situation is nearly the same, except that a small decelerating voltage is experience along with the large accelerating voltage described above for the accelerated beam. Off resonance, the voltage will lag or lead the current, depending upon the sign and degree of detuning.

The drive beam and accelerated beam are sequential bunches of premeditated particles spaced by v/f; or a multiple thereof, where v is the speed of the bunches, which can be essentially the speed of light for highly relativistic particles and f is the bunch frequency. The cavities are detuned either above for below f for a first mode and above or below 2f, 3f, 4f, . . . for multi-mode operation, with the fractional detuning $\Delta nf/f$ being nearly the same for all modes. Thus, the cavity is detuned with respect to the beam frequency. It is noted that the accelerated beam may have a different frequency than the drive beam by an integer that is a submultiple. Thus, for example, the accelerated beam may have bunches of particles that only occur for every two, three, etc., bunches of drive beam particles.

The amount of detuning can be controlled via the dimensions of the cavity. For example, larger dimensions cause negative detuning and smaller cavity dimensions provide positive detuning. For example, the length of a rectangular box cavity or the radius of a cylindrical cavity may be increased or decreased in order to provide a desired amount of detuning. An optimum phase lag between the test beam and the drive beam can be provided by adjusting the detuning.

For the case with cavity loss, the transformer ratio is given by the ratio of currents multiplied by an efficiency η, namely $$\chi = \eta\frac{I_d}{I_a} = \frac{2Q\frac{\Delta\omega}{\omega}\sin\varphi - \alpha - \cos\varphi}{2\alpha Q\frac{\Delta\omega}{\omega}\sin\varphi + 1 + \alpha\cos\varphi},$$

where the mode has a quality factor Q, resonance frequency ω, difference between cavity and bunch frequencies Δω, and phase difference ϕ between currents (the angle between $I_D$ and $I_A$). In the real world, the quality factor Q is not infinite and will provide a measure of energy that is lost.

The principle of two-beam acceleration using detuned cavities does not depend on the mass of either beam species. Therefore, this mechanism may be applied for two-beam acceleration of protons, muons, or heavier ions using either an electron or proton drive beam.

Figure 14A:
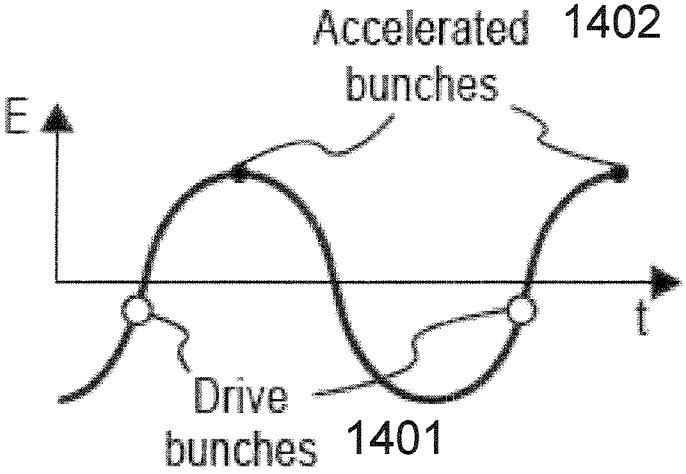
FIGS. 14*a* and 14*b* illustrate the electric field experienced by a detuned drive beam particle bunch and accelerated beam particle bunch in accordance with aspects of the present invention.
Figure 14B:
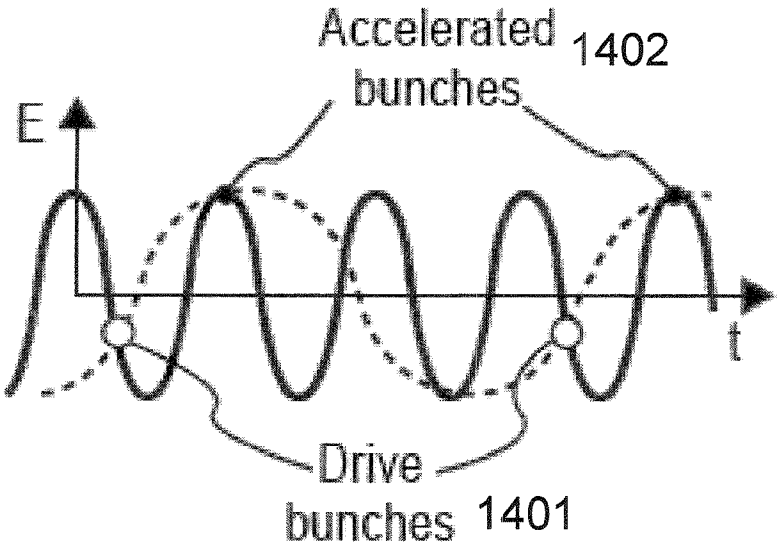

FIGS. 14*a* and 14*b* illustrate the electric field experienced by bunches of particles in the drive beam and the bunches of particles in the accelerated beam for a detuned cavity. FIG. 14*a* illustrates the electric field in the gap of the cavity versus time (t) for a single mode cavity, and FIG. 14*b* similarly illustrates the electric field for a two-mode cavity.

Adjusting the detuning of each mode separately allows one to compensate partly for the energy spread from the deceleration slope for the drive beam. FIGS. 14*a* and 14*b* show that the electric field of the operating mode is close to zero at the times when the drive bunches 1401 pass through the gap in the cavity, whereas the accelerated bunches 1402 arrive when the field is near a maximum. When the electric field is negative, it decelerates the passing bunch. Thus, the drive bunches in FIGS. 14*a* and 14*b* would decelerate, giving up some of their energy. When the electric field is positive, it provides a boost in energy to the passing bunches.

There is an additional advantage to a cavity that supports multiple harmonics, such as in FIG. 14*b*. When a particle bunch arrives at a slope, the electric field may be destabilizing to the bunch. This means that the particles that arrive first in the bunch may experience a different energy than those at the rear of the bunch, and if the bunch has a deceleration rate that is different at the front and the rear of the bunch, then the bunch might not maintain its shape. In FIG. 14*b*, the accelerator may be configured such that the drive bunches arrive at a time when the electric field from one harmonic has a rising curve and the electric field from another harmonic has a falling curve. In that situation, the two effects compensate for one another and assist in stabilizing the drive bunch.

The magnitude of detuning may be the same for each cavity employed in an accelerator or in a set of cavities within an accelerator. This is called "fixed detuning." It may also be advantageous to employ varying magnitudes of detuning in different cavities within the same accelerator, such as detuning of alternate signs in alternate cavities called "alternate detuning."

Detuning may be performed in sequence, with M cavities detuned positive and the next M cavities detuned negative, with the sequence continuing as desired. This may be applied in an accelerator for weakly relativistic particles, for example.

Sets of Cavities

Figure 15:
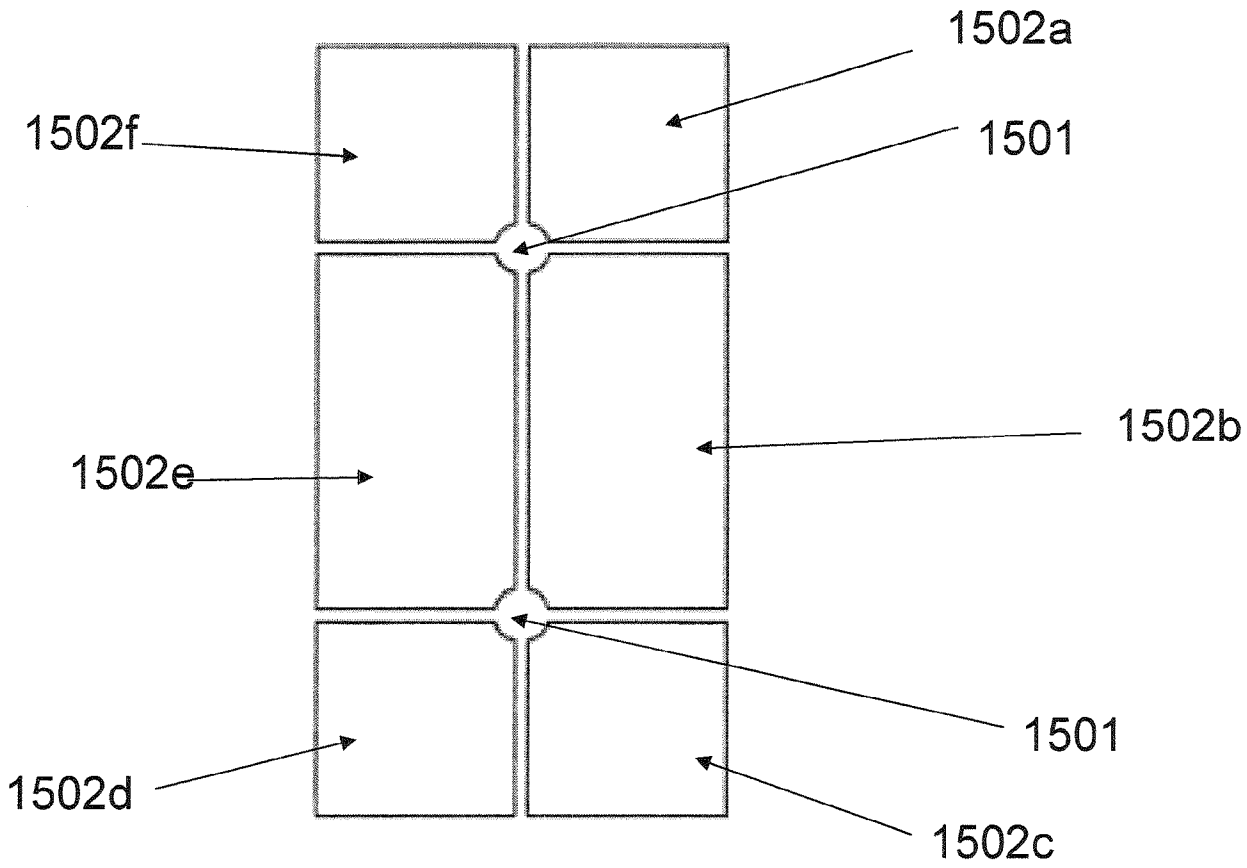
FIG. 15 illustrates a surface of an exemplary cavity comprising multiple pieces in accordance with aspects of the present invention.
Figure 16:
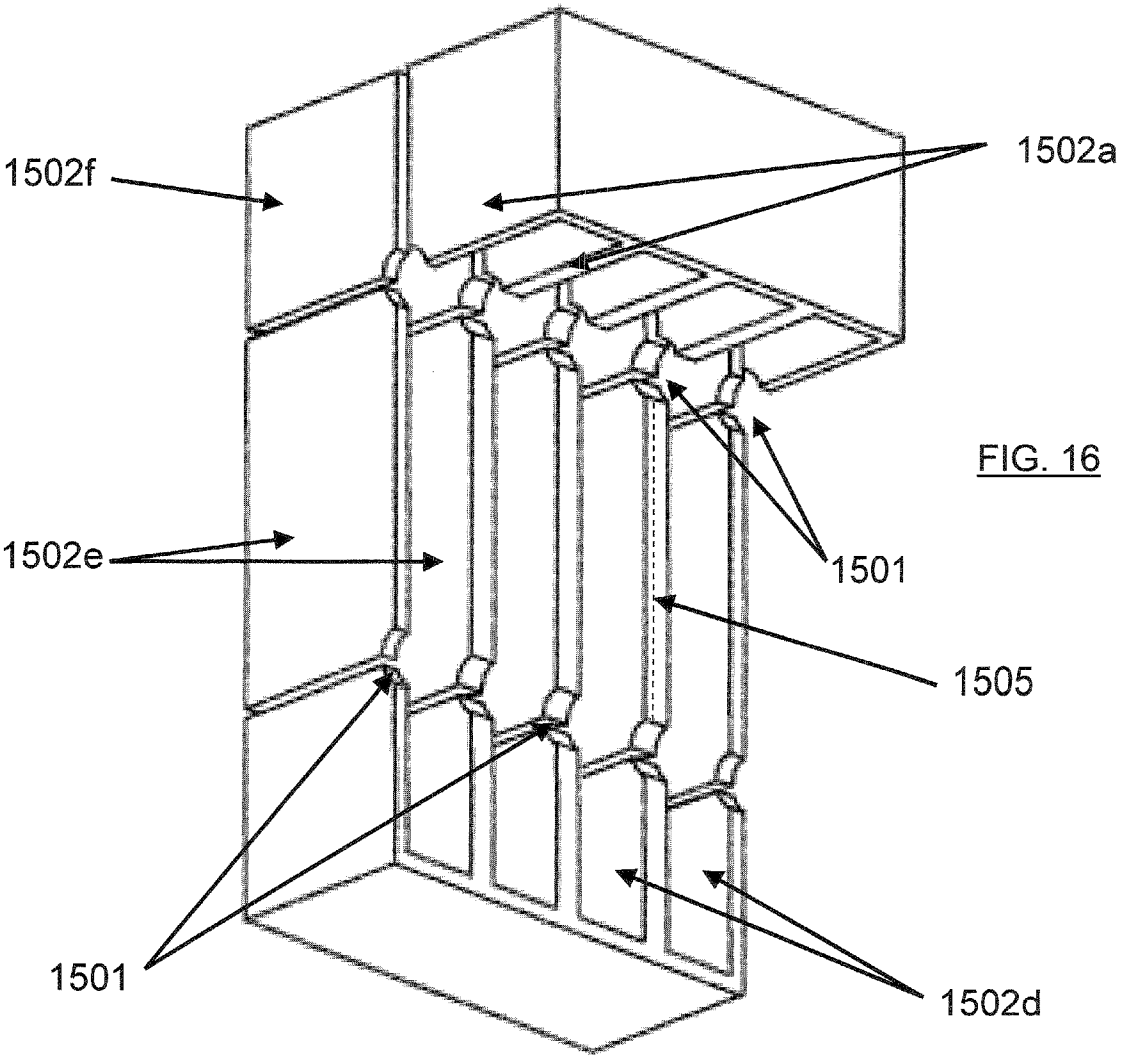
FIGS. 16 and 17 illustrate a cross-section set of multiple cavities in accordance with aspects of the present invention.

FIGS. 15 and 16 illustrate exemplary aspects of an illustrative set of cavities. FIG. 16 shows a series of four cavities placed adjacent to each other. For example, a resonant cavity can be made by forming sets of six pieces 1502*a-f* that are assembled to form the cavity. The six pieces are formed such that two openings 1501 are formed in each assembled wall perpendicular to the direction of travel of the two beams. These openings allow the beams to pass through the cavity. There is no requirement that the drive beam and acceleration beam pass through a particular opening nor is there a requirement that the beams pass in a particular direction through the cavity. As noted above, the two-cell cavity is preferably made of metal. Thus, the six pieces can be formed from a metal, such as by milling the pieces from a metal block. In one exemplary illustration, the pieces for the two-cell cavity may be milled from blocks of copper.

FIG. 15 illustrates that the six pieces 1502*a-f* for each cavity can be assembled, such as by using a slotted holding device (1503 in FIG. 17), in such a manner that multiple cavities are placed adjacent to each other. This assists in suppressing spurious modes and wake-fields. FIG. 15 shows the six pieces from the side of the cavity having a face perpendicular to the path of the drive beam and accelerated beam. Openings 1501 allow the beams to pass through the cavity. Similar openings would be provided on the opposite section of the cavity, thereby creating a space for the beams to exit the cavity.

By individually milling six separate sections to form portions of the cavity, the cavities can easily be produced with high precision.

Figure 17:
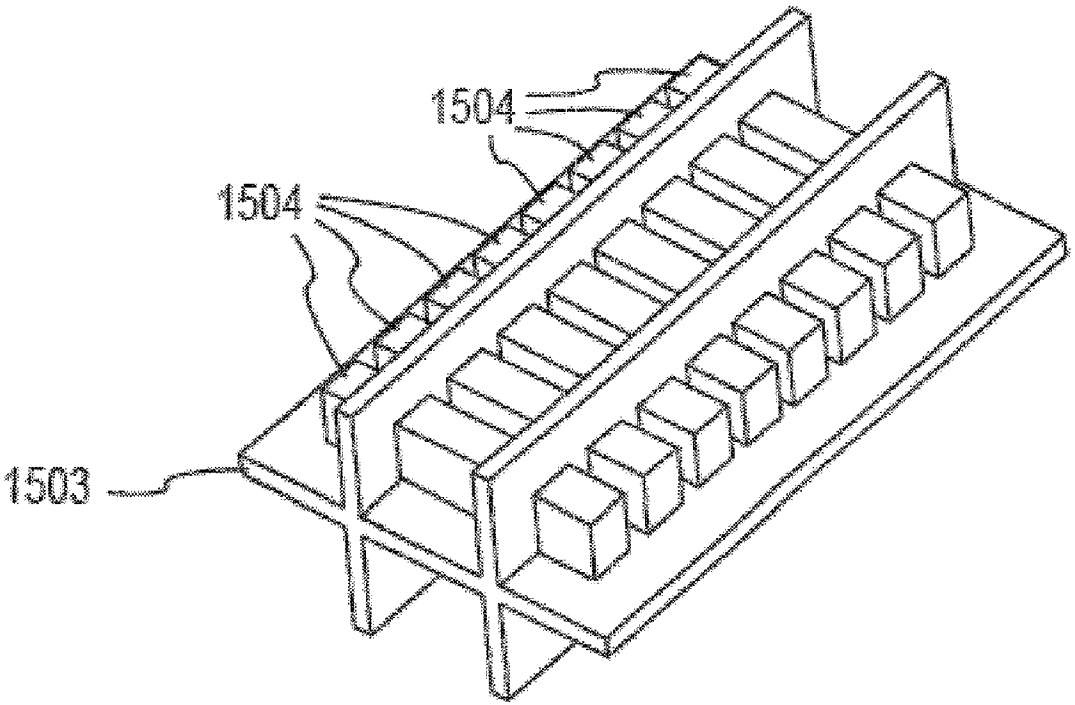

FIG. 16 illustrates an exemplary four cavity combination, with dashed line 1505 illustrating an exemplary separation between walls of adjacent cavities. In this illustration, the cavities share the wall, and there is no separation at the dashed line. In other embodiments, cavities may include separate walls. However, any number of cavities may be combined to form a path for the two beams. For example, FIG. 17 illustrates an exemplary set of eight cavities 1504. In theory, the set may include an infinite amount of cavities. However, balancing the need for precision in alignment and the need for beam focusing, the length of a set of cavities may be less than a meter, such as between 20-100 centimeters. Thus, a set of cavities may include two to a few dozen dual-box cavities.

Cavity Gap

The cavity gap width, h in FIGS. 8 and 9, can be determined using certain formulas. For example, the probability of breakdown may depend on the product ($E^n \times T$), where T is the effective pulse width, and where the exponent n might be 2 or 3. Formulas $I_2$ and $I_3$ provide potential information regarding the probability of breakdown, where G is the accelerating gradient and T is the time between accelerated bunches. Thus, $I_2$ and $I_3$ provide a possible measure of the benefit to be accrued through the use of a multi-mode or a single mode cavity, in addition to providing guidance for a gap width.

$$I_2 = \int_0^T E^2\,dt/G^2T$$

$$I_3 = \int_0^T E^3\,dt/G^3T$$

Figure 18A:
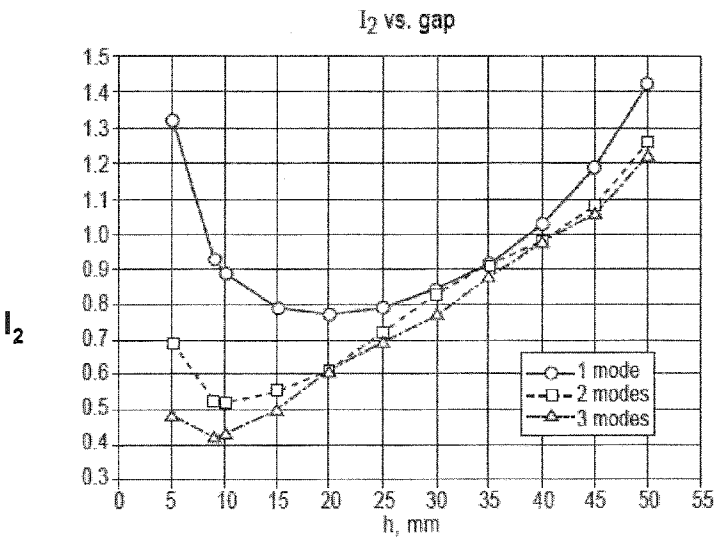
FIGS. 18*a* and 18*b* illustrate exemplary calculations of the factors $I_2$ and $I_3$ for various modes in accordance with aspects of the present invention.
Figure 18B:
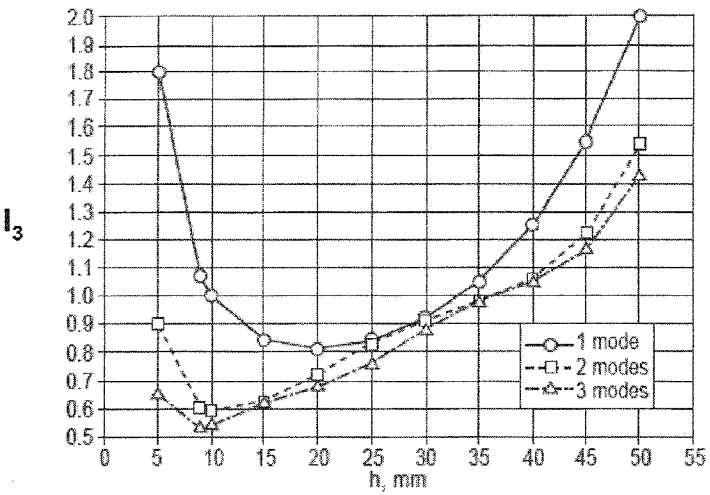

FIGS. 18*a* and 18*b* show exemplary illustrations of $I_2$ v. gap width and $I_3$ v. gap width for a square two-cell cavity, or a resonant cavity having a length to width ratio of 2:1, with operating modes at 3, 9, and 15 GHz, accounting for a 3 mm wall thickness. Based on these formulas, a cavity gap width may be selected to minimize formulas $I_2$ and $I_3$, or to minimize the possibility of breakdown. The optimal gap width varies depending on the amount of modes. FIGS. 18*a* and 18*b* are calculated for a cavity having transverse dimensions of 141.324 mm by 70.662 mm with a thickness of 3 mm, the optimum gap for 2-3 harmonics is 9 mm, while for 1 harmonic, it is 20 mm. These figures also show that the overall probability of breakdown is lower for three harmonics than for the one harmonic example. However, as discussed above, if three harmonics are employed, a higher number of cavities will need to be employed because the cavity gap is smaller when 2 or three modes are employed.

Thus, while FIGS. 18*a* and 18*b* illustrate that multi-mode cavities beneficially minimize $I_2$ and $I_3$ more than a single mode cavity, it is noted in practice that multiple modes are limited to about 4 or fewer modes, because the increase in modes includes an undesirable increase in frequency traveling through the cavity. As the frequency increases, the cavity gap width must be limited, which limits the amount of acceleration received per cavity.

Square Cavity

For a square cavity, the cavities natural eigenmodes have harmonically-related eigenfrequencies $\omega_{mn}$. Thus, for the $TM_{nm0}$ mode in a square box of side L, one has $(\omega_{mn} L/\pi c)^2=n^2+m^2$. Here, c is the speed of light and (n, m) are indices for transverse (x, y) field variations. The fields are uniform in the longitudinal z-direction. When n=m, $\omega_{mn}=\sqrt{2}n\pi c/L$, so this class of modes has eigenfrequencies that are harmonically related. If the desired modes are to have electric fields that peak at the center of the cavity, even values of n should not be excited. However, selective external excitation of this class of modes, and no others, can be difficult, and could require a separate phase locked high-frequency source for each mode, along with an intricate coupling scheme. The excitation of only the odd-harmonic modes can be effectively accomplished using a drive beam comprising a train of charge bunches injected at the frequency $\omega_{11}=\sqrt{2}\pi c/L$ along the axis of the cavity.

Non-Square Cavity

Figure 19A:
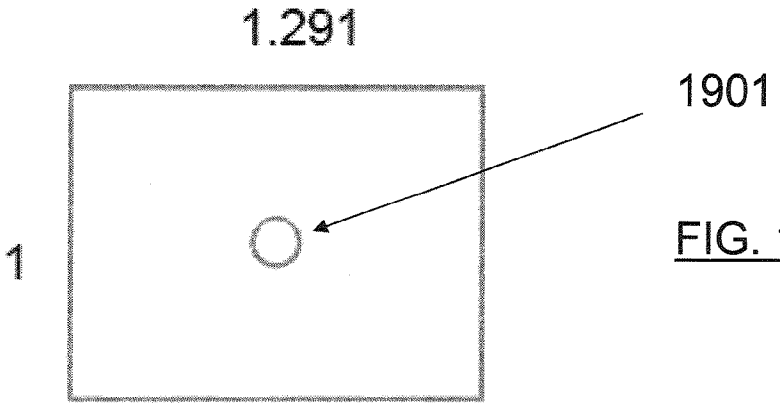
FIGS. 19*a* and 19*b* illustrate exemplary dimensions for a non-square cavity in accordance with aspects of the present invention.
Figure 19B:
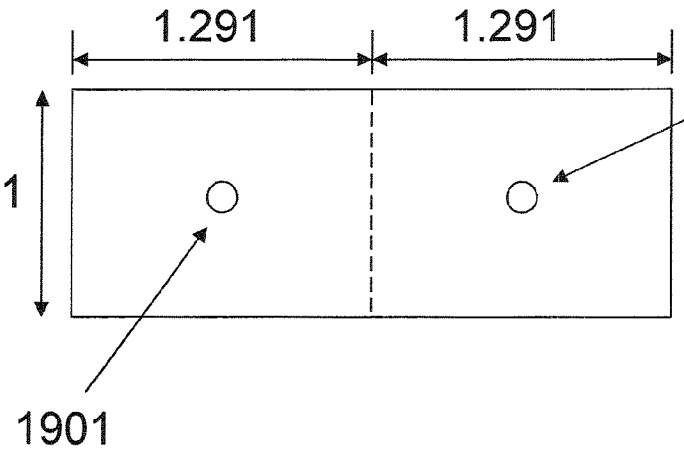

A square two-box cavity is not the only resonant cavity dimension that will enable a reduction in exposure time for a two-beam accelerator. Another exemplary illustration includes a two-rectangular box cavity with the central wall removed, each rectangle having a length to width ratio of 1:1.291 or $1:\sqrt{(5/3)}$. Thus, the combined dimensions for a two-box cavity may have a transverse length to width ratio of 2.582:1. In addition, the combined dimensions for the two-box cavity may have a transverse length to width ration of 1:1.291. FIG. 19*a* illustrates a single box having the appropriate dimensions, and FIG. 19*b* illustrates a dual box cavity with the center wall removed according to the dimensions of FIG. 19*a*. For the previously discussed square box having equal length and width dimensions, a certain set of the modes have operating frequencies that are harmonic multiples. 1901 are the channels or portions of the cavity through which the drive beam and accelerated beam pass. Similarly, for a cavity having the dimension of two boxes each having an individual ratio of 1:1.291, for modes $TM_{ii}$, such as $TM_{11}$-f; $TM_{13}$, $TM_{22}$-2f; $TM_{33}$-3f, $TM_{51}$, $TM_{44}$-4f; $TM_{55}$-5f; $TM_{39}$, $TM_{66}$-6f; $TM_{77}$-7f, you can have harmonic modes. Modes $TM_{22}$, $TM_{44}$, $TM_{66}$, have zero electric field at the beam location. Thus, these modes do not interact with the beam. In this exemplary implementation, all the harmonics will work, not just the odd ones. Thus, the operating spectrum may include f, 2f, 3f, 4f, . . . .

In this implementation, the $TM_{110}$ mode has eigenfrequency $\omega_{ii}=\sqrt{(8/5)}\pi c/L$ and $TM_{mn0}$ modes have eigenfrequencies equal to $n\omega_{11}$. But among these, only the odd-n modes will couple to a centered beam, as with the square box cavity. The modes $TM_{1,2,0}$, $TM_{5,1,0}$, $TM_{3,9,0}$, $TM_{1,13,0}$, and $TM_{5,15,0}$, have resonances at $2\omega_{11}$, $4\ \omega_{11}$, $6\ \omega_{11}$, $8\ \omega_{11}$, and $10\ \omega_{11}$, respectively, and will also coupled to a centered beam. Thus, this cavity has a spectrally dense amount of spurious modes in comparison to the square box cavity illustration.

Cylindrical Cavity

Figure 20B:
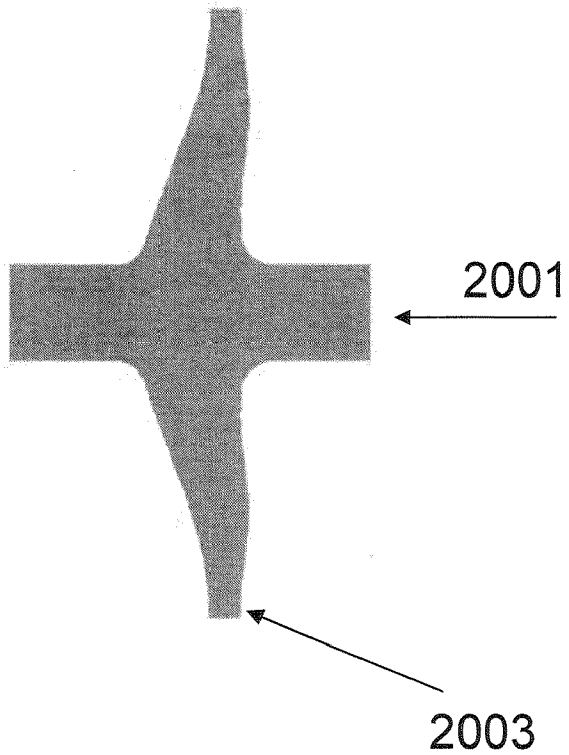
FIG. 20*a-b* illustrates a cylindrical cavity in accordance with aspects of the present invention.
Figure 20A:
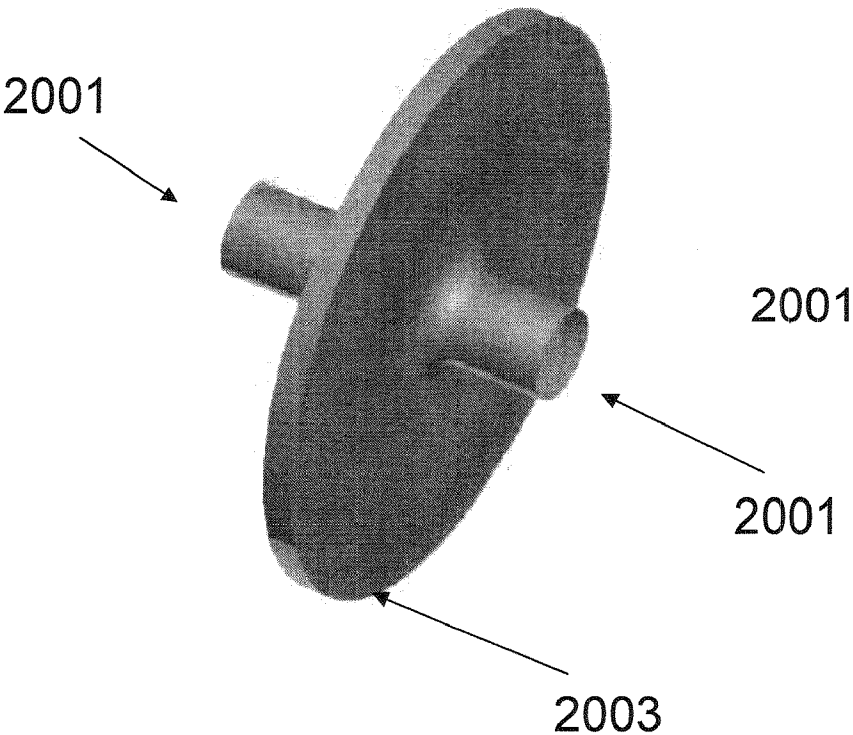
Figure 21:
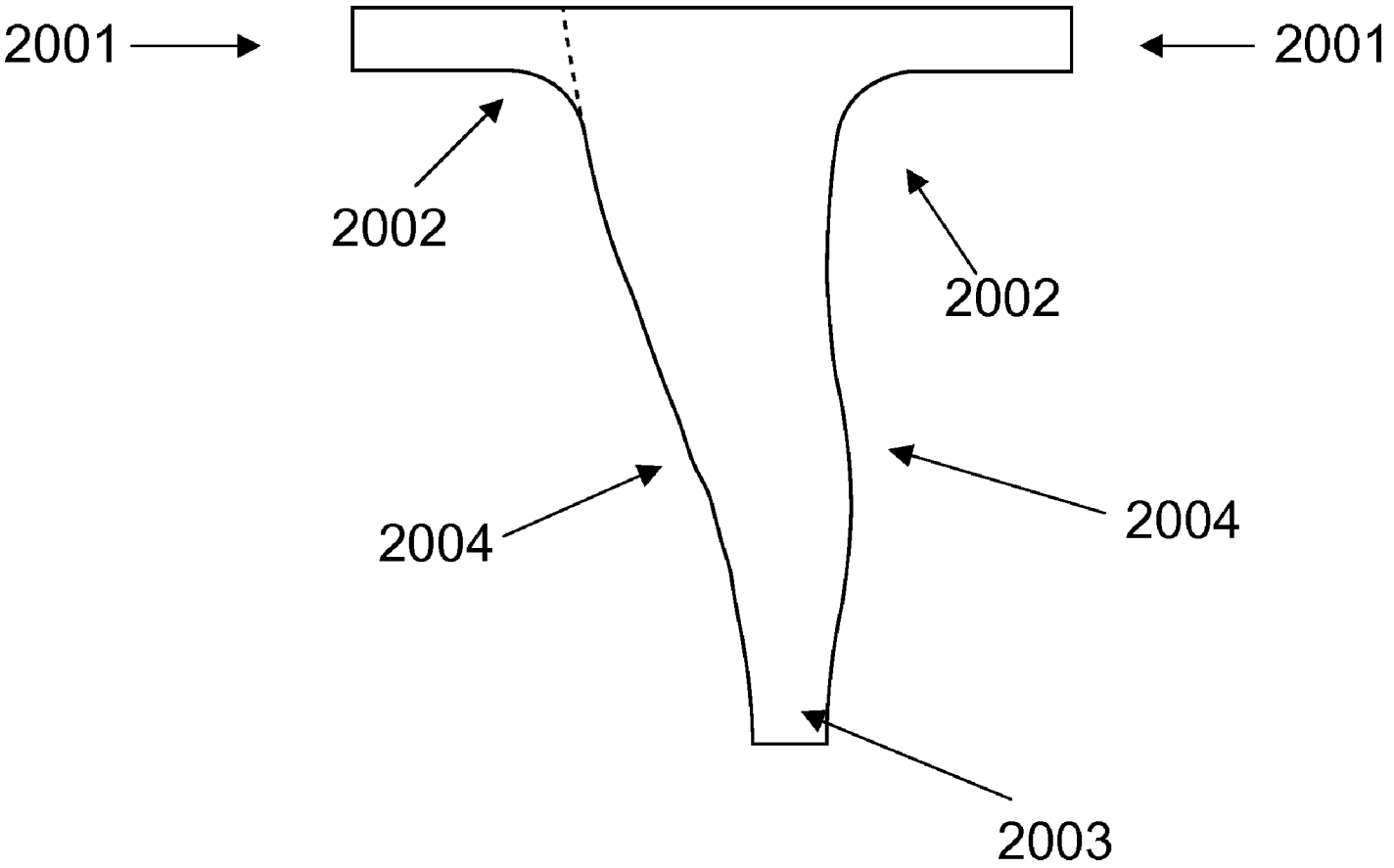
FIG. 21 illustrates a cylindrical cavity in accordance with aspects of the present invention.

Another implementation may include a cylindrical, axisymmetric cavity. This type of a cavity avoids field enhancements in sharp corners that can occur in a square or rectangular cavity. A cylindrical cavity enables a maximization of the Q factor and facilitates ease of fabrication. For example, a cylindrical cavity, such as a metal cylindrical cavity, can be constructed on a lathe. FIGS. 20*a*, 20*b*, and 21 illustrate one exemplary implementation of an axisymmetric cavity having three axisymmetric harmonically related modes. This cavity is referred to herein as a modified cylindrical pillbox. The usual planar end walls are profiled to form sinusoids. FIGS. 20*a* and 20*b* show a perspective view and a cross section, respectively, of the modified pillbox cavity.

FIG. 21 illustrates exemplary dimensions for an exemplary implementation of the modified pillbox cavity. For example, the central channel 2001, through which a co-linear drive beam and accelerated beam travel may have a radius of about 4 mm. The curvatures 2002 leading to the central cavity portion may be shaped to have a radius of curvature of about 5 mm. The radial extension 2003 may extend about 46.43 mm on each side of the central axis. The width of the radial extension 2003 may be about 4.75 mm at the end of the radial extension, with a reduction of 1.37 mm on one side and 11.42 mm on the other side of the radial extension from the widest portion of the radial extension nearer to the axis. The planar end walls 2004 are shaped with a sinusoid profile.

Figure 22:
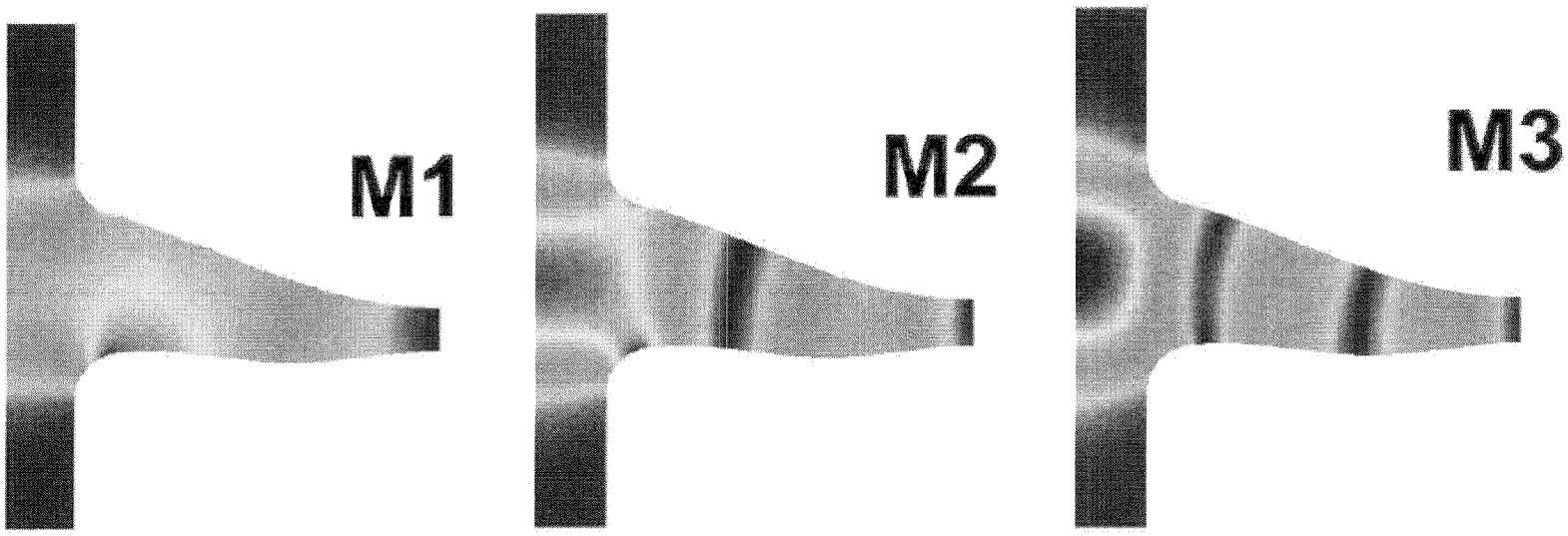
FIG. 22 illustrates fields within a cylindrical cavity in accordance with aspects of the present invention.

FIG. 22 illustrates field maps for an exemplary axisymmetric modified pillbox cavity for one mode M1, two modes M2, and three modes, M3 with harmonically-related eigenfrequencies. The mode eigenfrequencies and Q-factors found for the first three axisymmetric modes of this cavity are 3.00045 GHz, $5.645\times10^3$; 6.00359 GHZ, $8.52024\times10^3$; and 8.99912 GHz, $1.12881\times10^4$. The modified pillbox illustration may be further modified in order to bring the frequencies closer to 3, 6, and 9 GHZ. It is advantageous to operate without the need to skip modes with even indices as shown here, because this lowers the frequencies for the modes above the first and avoids a reduced transit time. As discussed above, higher frequencies require a shorter transit time. A chain of cavities, or a set of cavities may be used to comprise an accelerator section.

Focus

When transporting particle beams, such as the drive beam and the acceleration beam, periodic focusing devices or mechanisms help to assure that the beams maintain a straight and narrow path necessary for collision. Traditional focusing devices are structured to focus a single beam. In the two-beam accelerator, the two beams are closely located, such as a few centimeters from each other. As the beams will have different energies and will pass through separate areas, different focusing systems may be applied to the separate beams. The selection of an S-band for a fundamental harmonic can provide enough space to separate beam channels in order to separately focus each beam.

One conventional way to focus a single beam is via a quadrupole magnet ("quad"). A quadrupole has four poles that are alternately polarized north, south, north, south. Thus, at the axis of the quadrupole, there is no magnetic field, but at a position away from the center, a magnetic field exists that would move any straying charged particles back towards the center. Therefore, an array of quads acts somewhat like a lens by focusing a beam of charged particles into a central path. A set of three quads may be used to focus a beam.

However, a two-beam accelerator has two closely located beams both of which need to be focused, and both beams cannot pass through the center of a quad.

Figure 23:
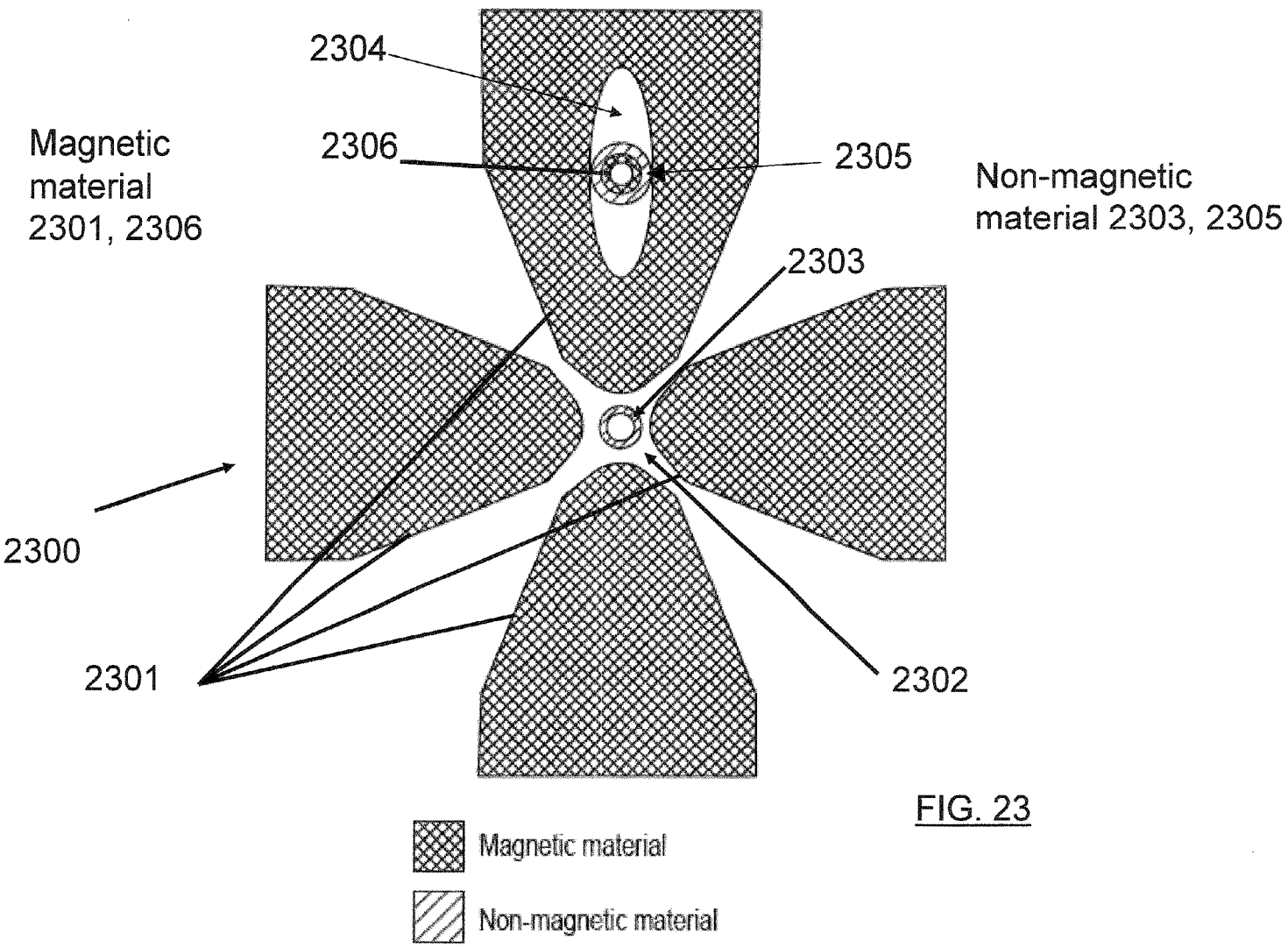
FIG. 23 illustrates a modified quadrupole magnet for focusing beams in a two-beam accelerator in accordance with aspects of the present invention.

FIG. 23 illustrates aspects of an exemplary focusing device for a two-beam accelerator that overcomes the problems associated with a standard quad. The center 2302 of the modified quadrupole magnet 2300 comprises a non-magnetic material 2303. Thus, a beam passing through the non-magnetic material 2303 would be focused by the modified quadrupole magnet 2300 as discussed above for the standard quadrupole magnet. An opening 2304 formed in one of the magnets includes another central portion comprising a non-magnetic material 2305. Within the non-magnetic material is an inner layer of magnetic material 2306, such as iron or another metal, which neutralizes the magnetic field. Thus, the beam that passes through the center 2302 of the modified quadrupole will be focused by the modified quadrupole's magnetic field and the beam that passes through the opening 2304, 2305, 2306 in one of the modified quadrupole's magnets, does not experience a focusing magnetic field.

Alternating sets of modified quads may be used in combination in order to focus both beams of particles. For example, a first set of quads may be configured to pass the acceleration beam through the center portion 2302 in order to focus the acceleration beam, while the drive beam passes through channel 2306 within one of the four magnets and does not experience a magnetic field. A second set of modified quads may be placed adjacent to the first set, in a manner that the drive beam passes through the central portion of the modified quads in order to focus the drive beam particles, while the acceleration beam passes through an opening in one of the modified quadrupole magnets that has been configured with a lining of magnetic material to shield the acceleration beam from a magnetic field. The opening in the modified quadrupole may be placed in any of the four magnets. Thereby, both sets of beams will be focused.

As different sets of modified quads are used in order to focus the two beams, the modified quads may be selected to interact with beams of different energies within a single accelerator.

Accelerator System

Figure 24:
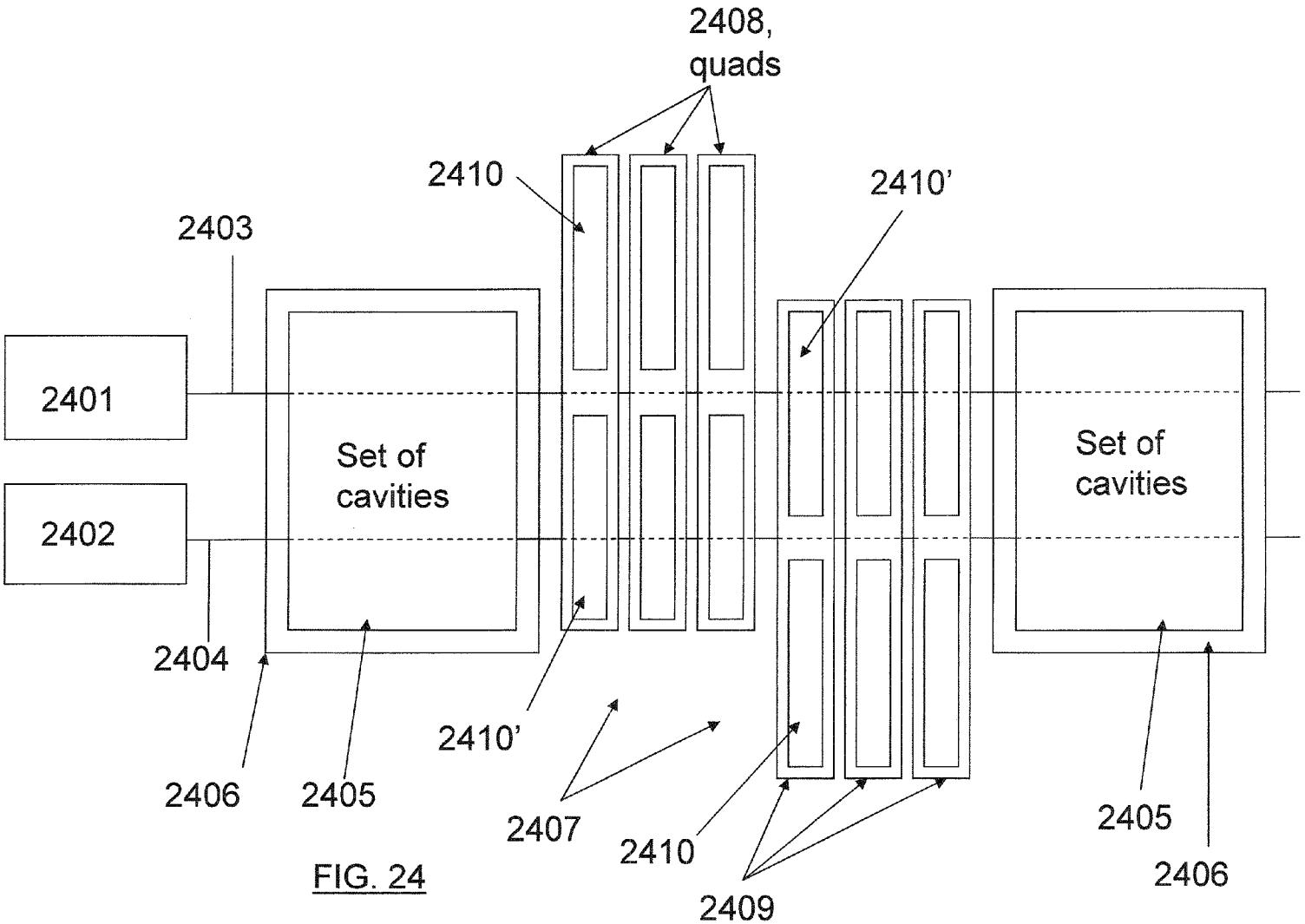
FIG. 24 illustrates an accelerator in accordance with aspects of the present invention.

FIG. 24 illustrates an exemplary accelerator including an external drive beam accelerator 2401, an accelerated beam source 2402, which send a detuned drive beam 2403 and a detuned accelerated beam 2404, as discussed above, into a set of resonant cavities 2405. The resonant cavities may be dimensioned as discussed in connection with FIGS. 7-9, 15-17, and 19. The set of cavities 2405 is illustrated as having a surrounding pumping manifold 2406. Among other ways, the accelerator will need a vacuum source, and this may be provided via a pumping manifold that surrounds the sets of cavities. For example, gaps between the six pieces illustrated in FIGS. 15 and 16 may lead to a surrounding manifold. This would reduce the need for additional space for a pumping mechanism along the accelerator. However, a pumping manifold may be placed in another location.

Two sets of cavities 2405 are shown in FIG. 24, however, an actual accelerator may include a sequence with any number of sets of cavities placed along the line of the beams. Also, as noted above, each set may include any number of individual resonant cavities.

Focusing devices 2407 may be situated between adjacent sets of cavities 2405 in order to focus the drive beam and the accelerated beam. Among others, the modified quadrupole type focusing mechanism discussed herein may be used. FIG. 24 illustrates a set of three modified quads 2408 for focusing the drive beam 2403, and a set of three modified quads 2409 for focusing the accelerated beam 2404. Each modified quad includes four magnets 2410, one of which is modified with an opening and channel as described in connection with FIG. 23. However, the number of modified quads in a set may be modified in order to obtain the desired amount of focusing for a beam. Likewise, a single modified quad or a single set of modified quads may be placed between adjacent sets of cavities 2405 for focusing one of the two beams.

Although the drive beam is illustrated in a position above the accelerated beam, both beams may be in either position. Furthermore, as discussed below, the drive beam and the accelerated beam may be driven in the same or in opposite directions. If the drive beam and the accelerated beam are traveling in opposite directions, the accelerated beam source would be located opposite the sets of cavities 2405 from the external drive beam accelerator.

Acceleration in Either Direction

Aspects of the accelerating device and method in accordance with the present invention include having a detuned resonant cavity that can accelerate particles in either direction, with a phase velocity in the accelerating channel that is much less than the velocity of the drive beam.

If the signs of the detuning are the same in all cavities, the phase velocity in the accelerating channel has the same value and direction as that in the drive channel.

However, if the signs of detuning in neighboring cavities are opposite and if the structure has a period $\lambda/4$, the phase velocity in the accelerating channel has the same value as that in the drive channel but in the opposite direction. Thus, it is possible to accelerate a beam traveling in a direction opposite to that of the drive beam.

Further, if the period of a structure with alternate detuning is much less than $\lambda$, the phase velocity in the accelerating channel will be much smaller than the phase velocity in the drive channel and in the same direction. Thus, for example, a high-gradient proton two-beam accelerator may be possible, using an electron drive beam.

The fact that the phase velocity in the accelerating channel would be much smaller than the phase velocity in the drive channel is important because heavy particles such as protons move more slowly than electrons. Therefore, a low phase velocity is necessary in order to synchronize with the protons. Therefore, aspects in Co-Linear Propagation Aspects also include a co-linear two-beam accelerator, where the drive beam and the accelerated beam travel along the same channel. The particle beams are modeled as a periodic sequence of tight bunches. In this illustration, decelerated drive bunches and accelerated bunches, also referred to herein as "test bunches" travel co-linearly with respect to each other. The drive bunches and test bunches may be injected at the same frequency, for example, such that the test bunches are uniformly interleaved between drive bunches.

When the two beams travel co-linearly, it is still possible to propagate the beams in opposite directions. For example, if the drive beam is propagated in the z direction on-axis through a cavity, the accelerated beam may propagate either forward along the z direction or backward along the −z direction, also on axis through the cavity.

In an accelerator using a co-linear arrangement, the particles in the test bunch can acquire energy at a rate that cannot exceed about twice the average energy loss of particles in a drive bunch. Thus, the transformer ratio will not normally exceed a value of two. Through the use of detuned cavities, the transformer ratio can be increased to a practical level for acceleration.

Figure 25:
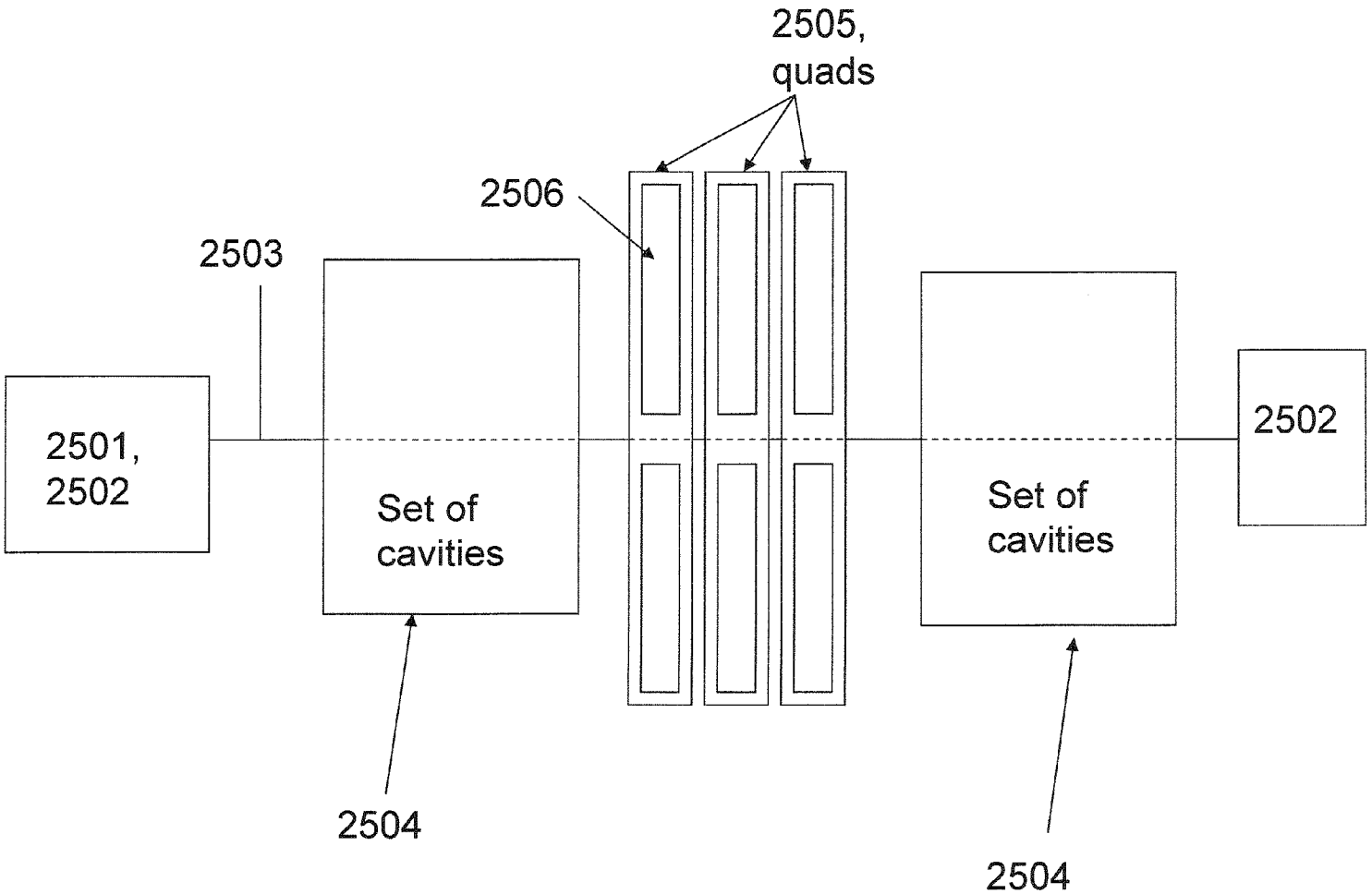
FIG. 25 illustrates an accelerator in accordance with aspects of the present invention.

FIG. 25 illustrates an exemplary accelerator having co-linear propagation. The accelerator includes an external drive beam accelerator 2501, an accelerated beam source 2502, which send a detuned, co-linear drive beam and accelerated beam 2503, into a set of resonant cavities 2504. The accelerated beam source 2502 may be located on the same side or on an opposite side from the drive beam source 2501, depending on whether the beams will propagate in a parallel manner or in an anti-parallel manner. The resonant cavities may be axisymmetric cavities, such as the modified pillbox implementation discussed in connection with FIGS. 20-22. Two sets of cavities 2502 are shown in FIG. 25, however, an actual accelerator may include a sequence with any number of sets of cavities placed along the line of the beams. Also, as noted above, each set may include any number of individual resonant cavities.

Focusing devices 2505 may be situated between adjacent sets of cavities 2504 in order to focus the drive beam and the accelerated beam. Among others, a quadrupole type focusing mechanism having four magnets 2506 may be used.

Reduction in Fill Time

Excitation of detuned cavities involves a filling time, as for tuned cavities, except that the customary exponential buildup of cavity fields has interference beats at the detuning frequency interval superimposed upon it. Energy dissipated during cavity fill times represents an inefficiency, elimination of which would be advantageous in many applications.

Aspects in accordance with the present invention include modifying the beam amplitude or phase in order to reduce the effective beam filling time. The drive current I is at frequency $\omega$, which is slightly detuned from the cavity resonance frequency $\omega_0=\sqrt{(1/LC)}$, where L is length, such as of a box cavity and C is the effective cavity capacitance. For small detuning, $\Delta\omega=\omega-\omega_0$.

Figure 27:
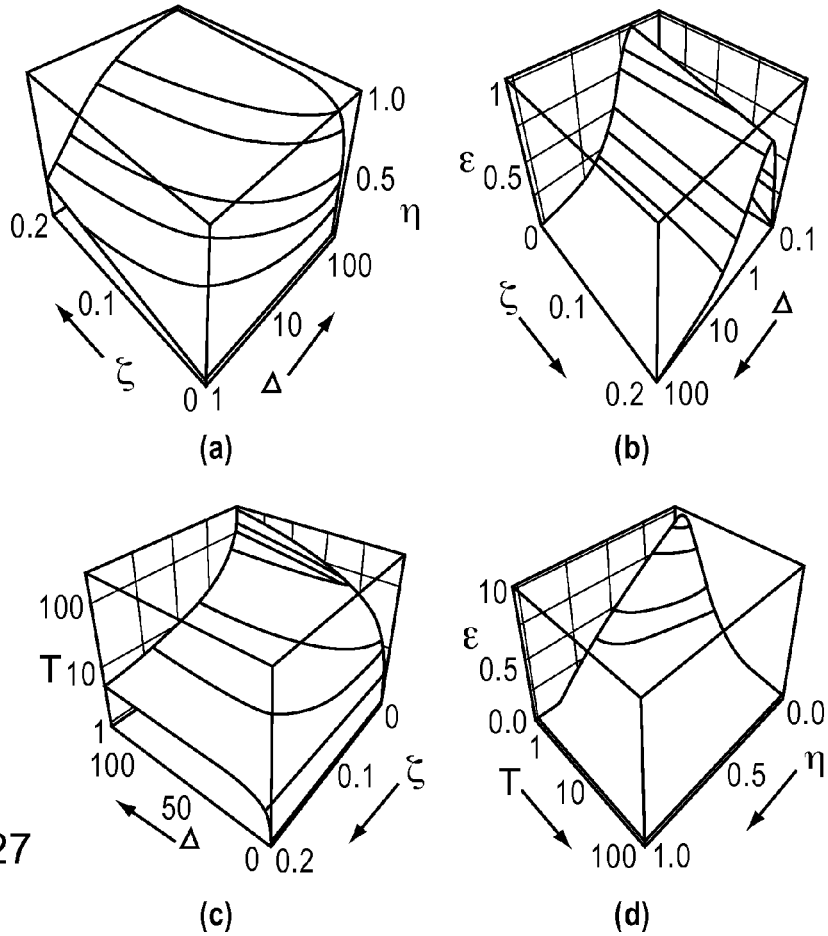
FIG. 27 illustrates the interrelationship between parameters for an acceleration cavity.

In one exemplary illustration, the filling time may be reduced by injecting a pre-pulse current $I_1$ prior to the main current $I_2$. For example. FIG. 27*a* illustrates an exemplary pre-pulse $I_1$ that rises at $t=-t_1$ with pulse width T that induces a voltage $V_1$, followed by a step pulse $I_2$ at t=0, where $V_1$ is $$V_1 = \frac{I_1 \mathrm{Re}^{i\omega t} e^{i\Delta\omega t} e^{-t/\tau}}{1 + i2Q\Delta\omega/\omega} e^{-i\Delta\omega t_1} e^{-t_1/\tau} e^{i\omega t_1} (1 - e^{i\Delta\omega T} e^{T/\tau})$$

Where $$\frac{V}{R} + C\dot{V} + \frac{1}{L}\int V dt = I e^{i\omega t}$$

and where the Quality factor $Q=R/\omega_0$. $L=RC\omega_0$. $I_1$ may be selected such that $I_1=I_2 e^{(t_1-T)/\tau} e^{-i\omega t_1}/(1-e^{-i\Delta\omega T} e^{-T/\tau})$. $I_1$ and $I_2$ may be phase locked and the pre-pulse width may be $T=n\pi/\Delta\omega$, with n equal to an integer.

Figure 26B:
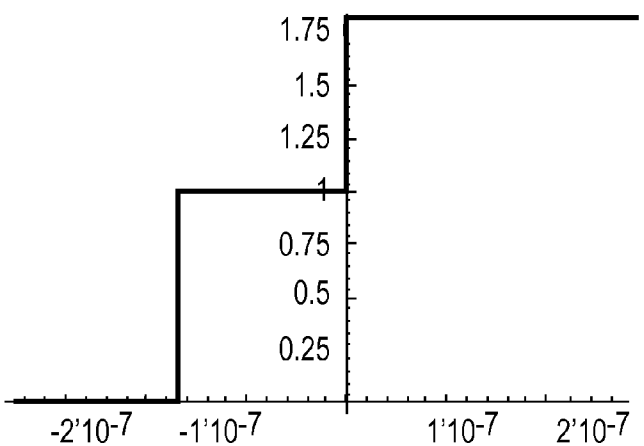
FIGS. 26*a-c* illustrate exemplary aspects for reducing filling time, in accordance with aspects of the present invention.
Figure 26A:
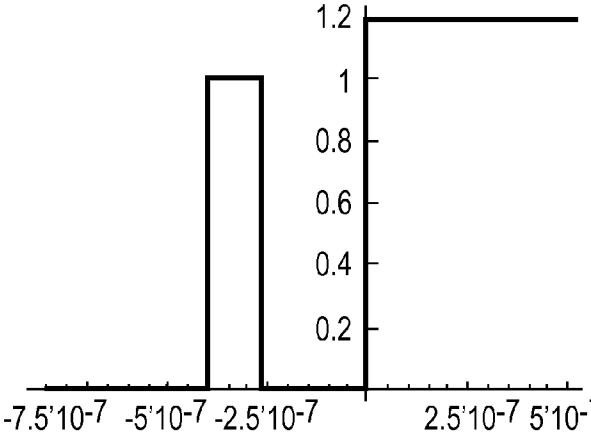
Figure 26C:
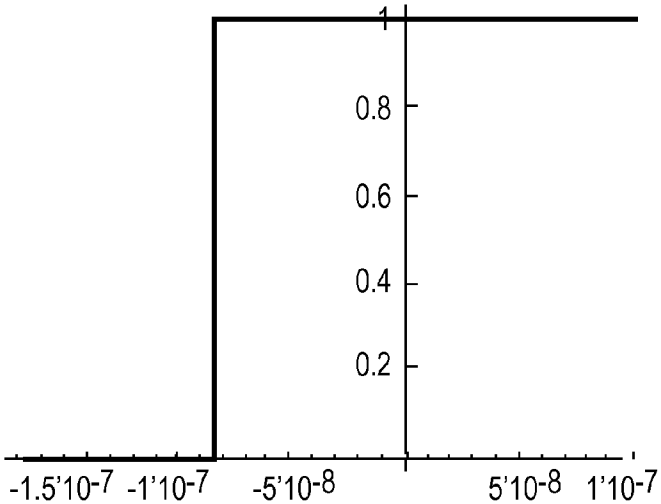

In another exemplary implementation, the amplitude or phase of the first step $I_1$ relative to the following step $I_2$ may be modulated, as illustrated in FIGS. 26*b* and 26*c*. As illustrated in FIG. 26*b*, $I_1$ can be phase locked with $I_2$ and a step width $T=2\ n\pi/\omega$ can be used with detuning $\Delta\omega=\omega/m$, such that the first current $I_1=I_2/(1\pm e^{-T/\tau})$.

As illustrated in FIG. 26*c*, the phase may be shifted equal to $(2\Delta\omega-\omega)T$, where $e^{-T/\tau}=2\cos\Delta\omega T$ with the constraint $\Delta\omega T>\pi/6$, such that $I_1=I_2 e^{i(2\Delta\omega-\omega)T}$.

Balance Among Parameters

FIG. 27*a-d* illustrates the interrelationship of the efficiency $\eta$, normalized gradient seen by test particles $\epsilon$, transformer ratio T, each as a function of modified current ratio $\zeta$ and normalized detuning $\Delta$. FIG. 27*d* shows $\epsilon$ as a function of T and $\eta$.

FIGS. 27*a* and *b* illustrate the strong trade-off between efficiency and accelerating gradient $\epsilon$. FIG. 27*a* shows that the efficiency $\eta$ is high for a large detuning $\Delta$ and large current ratio $\zeta$, while FIG. 27*b* shows that the accelerating gradients peaks with the detuning factor $\Delta$ being approximately 1 and falls as the current ratio $\zeta$ increases. FIG. 27*c* shows that the transformer ratio T is a strong function of current ratio $\zeta$, decreasing as current ratio $\zeta$ increases, but that it is a weak function of detuning $\Delta$, unless the detuning $\Delta$ is small—in which case T is also small. FIG. 27*d* shows that the accelerating fields $\epsilon$ falls as transformer ratio T and efficiency $\eta$ increase. Therefore, FIG. 27*a-d* illustrates that there is a trade off among these parameters in order to optimize acceleration. These relationships provide guidance in optimizing the cavity design.

These interrelationships provide guidance in optimizing structure design for a particular application. The fundamental parameters cavity peak field amplitude $E_T$ seen by the accelerated test particles, the power transfer efficiency $\eta$ between drive and accelerated beams, and the transformer ratio T may be modified in order to optimize production and performance. These parameters depend upon cavity detuning $\delta=\Delta\omega/\omega$, cavity quality factor Q, and modified current ratio $\zeta$ between the beams. It is important to note that each beam is only characterized by its current and normalized particle velocity $\beta$, and not explicitly by the beam energy or beam particle mass.

Exemplary Electron Accelerator

An exemplary electron accelerator may use copper modified pillbox cavities similar to those illustrated in FIGS. 20-22 that cause eigenfrequencies for $TM_{0n0}$-like modes to be nth harmonics of that for n=1. The drive beam may be, for example, 100.8 A, and the accelerated beam may be, for example, 4.8 A. For each 1.5 TeV accelerated beam as in a 3.0 TeV c.o.m. collider with an average power of 14 MW the average current is $9.33\times10^{-6}$ A. The bunch frequency may be 3.0 GHz, the Gaussian bunch lengths may be 15 ps (4.5 mm), the cavity gap widths may be 3.65 mm, and the walls between cavities may be 1 mm thick. An acceleration gradient of over 150 MV/m is predicted for a cavity detuning $\Delta\omega/\omega=0.9\times10^{-3}$ with a transformer ratio of 13:1 and a beam-to-beam power transfer efficiency of 60% Thus, a 2.5 GeV drive beam should increase the accelerated beam energy by about 30 GeV in a section having an active length of about 200 m. Fifty sections would accelerate to 1.5 TeV, in a total active length of 10 km. Wall losses are small. FIG. 28 illustrates additional exemplary parameters.

A related positron accelerator could be provided in an identical manner, except that the relative phase between the drive beam and the accelerated beam would need to be modified.

Exemplary Proton Accelerator

An alternately detuned cavity structure can provide synchronism between a high-current electron drive beam and an oppositely directed low-β proton beam. For example, a co-linear two-beam accelerator may be used that exhibits a moderate-to-high transformer ratio, which provides flexibility in choosing the beam energy for the high-power electron drive beam to maximize its efficiency and to minimize cost. For example, a 10 MW, 1.0 GeV proton drive may be used. FIGS. 29-31 illustrate parameters for exemplary illustrations of such a proton accelerator. The electron drive current may be 25.2 A, the proton accelerated current may be 2.4 A, giving a proton pulsed power of 2.4 GW, a duty factor of $4.2\times10^{-3}$ gives an average beam power of 10 MW. The bunch frequency may be 3.0 GHz, and the Gaussian bunches maybe 15 ps long. The cavity frequencies may be alternately detuned with $\Delta\omega/\omega$ values as listed in the table captions. The drive bunches may be 8.4 nC while the proton bunches may be 0.8 nC each, i.e. $5\times10^9$ protons/bunch.

These figures illustrate that a reasonably efficient normal conducting 10 MW, 1 GeV proton drive may have an active length on the order of 50 m or less, not including the space for the 50 MeV proton injector and electron drive linac.

Advantages and Comparison to CLIC

Calculations regarding the advantages of a multi-mode cavity and comparisons to other particle accelerators, such as CLIC, are discussed in Provisional Application No. 61/146,581 entitled "MULTI-MODE, MULTI-FREQUENCY, TWO-BEAM ACCELERATING STRUCTURE" and in "Two-Beam, Multi-Mode Detuned Accelerating Structure" by S. Yu. Kazakov, S. V. Kuzikov, V. P. Yakolev, and J. L. Hirshfield, 2009 American Institute of Physics 978-0-7354-0617-0/09, Advanced Accelerator Concepts 13$^{th}$ Workshop, pages 439-444, the entire contents of which are incorporated herein by reference.

Aspects of the two-beam, multi-mode, detuned accelerating structure provide results comparable to those for CLIC. Table 1 lists CLIC parameters published at http://clic-meeting.web.cern.ch/clic-meeting/clictable2007.html, the entire contents of which are incorporated herein by reference.

TABLE 1

| CLIC Drive Beam Parameters | | CLIC Accelerated Beam Parameters | |
|---|---|---|---|
| Bunch charge | $Q_{DB}$ = 8.4 nC | Bunch charge | $Q_{AB}$ = 0.595 nC |
| Bunch separation | $T_{DB}$ = 0.083 ns (12 GHz) | Bunch separation | $T_{AB}$ = 0.50 ns (2 GHz) |
| Drive current | $I_D$ = 101 A (8.4 × 12) | Acceleration current | $I_A$ = 1.19 A (0.595 × 2) |
| Bunches/train | $N_{DB}$ = 2904 | Bunches/train | $N_{AB}$ = 312 |
| Total train charge | $Q_{TD}$ = 24393.6 nC | Total train charge | $Q_{TA}$ = 185.6 nC |
| Deceleration unit length | $L_D$ = 868 m | Acceleration/unit | $U_A$ = 62.5 GeV |
| Deceleration/unit | $U_D$ = 2.142 GeV | RF-to-beam efficiency | 27.7% |
| Drive-to-RF efficiency | 65% | Acceleration gradient | G = 100 MeV/m |

Thus, for the CLIC design, the power efficiency $\eta_I=(I_A\times U_A)/(I_D\times U_D)=0.344$, the energy efficiency $\eta_Q(Q_{TA}\times U_A)/(Q_{TD}\times U_D)=0.222$, the transfer efficiency, $\eta_T=0.65\times 0.277=0.180$, and the transformer ratio $\chi=62.5/2.142=29.18$. Thus, the efficiency falls between 18-34%.

The following tables illustrate that aspects of the accelerator structure described herein provide favorable results when compared to the CLIC parameters. For example, a two-box cavity having a single mode, dual, or triple mode provides the parameters shown in table 2.

TABLE 2

| | $Q_d$ = 8.4 nC G = 100 Mv/m | $Q_d$ = 8.4 nC G = 150 Mv/m | $Q_d$ = 16.8 nC G = 100 Mv/m | $Q_d$ = 16.8 nC G = 150 Mv/m | $Q_d$ = 33.6 nC G = 100 Mv/m | $Q_d$ = 33.6 nC G = 150 Mv/m |
|---|---|---|---|---|---|---|
| Single Mode Cavity, h = 25 mm, f = 3 GHz | | | | | | |
| $I_{drive}$ | 25.2 A | 25.2 A | 50.4 A | 50.4 A | 100.8 A | 100.8 A |
| $I_{acc}$ | 1.2 A | 1.2 A | 1.2 A | 1.2 A | 1.2 A | 1.2 A |
| $Q_{acc}$ | 0.4 nC | 0.4 nC | 0.4 nC | 0.4 nC | 0.4 nC | 0.4 nC |
| Transformer ratio χ | 7.49 | 5.62 | 15.13 | 11.44 | 30.44 | 23.04 |
| Efficiency | 35.5% | 26.7% | 35.9% | 27.1% | 36.1% | 27.3% |
| E_max | 126 MV/m | 188 MV/m | 126 MV/m | 188 MV/m | 126 MV/m | 188 MV/m |
| $df_1/f_1$ | 4.30E−4 | 2.843E−4 | 8.70E−4 | 5.793E−4 | 1.75E−3 | 1.167E−3 |
| Two Mode Cavity, h = 15 mm, f1 = 3 GHz, f2 = 9 GHz | | | | | | |
| $I_{drive}$ | 25.2 A | 25.2 A | 50.4 A | 50.4 A | 100.8 A | 100.8 A |
| $I_{acc}$ | 1.2 A | 1.2 A | 1.2 A | 1.2 A | 1.2 A | 1.2 A |
| Transformer ratio χ | 6.75 | 4.96 | 13.75 | 10.22 | 28.45 | 20.59 |
| Efficiency | 32% | 23.5% | 32.6% | 24.3% | 33.7% | 24.4% |
| E_max | 142 MV/m | 215 MV/m | 142 MV/m | 215 MV/m | 142 MV/m | 215 MV/m |
| $df_1/f_1$ | 7.50E−4 | 4.933E−4 | 1.50E−3 | 1.0E−3 | 2.833E−3 | 2.0E−3 |
| $df_2/f_2$ | −2.078E−4 | −1.351E−4 | −4.273E−4 | −2.817E−4 | −9.193E−4 | −5.528E−4 |

TABLE 2-continued

| | $Q_d$ = 8.4 nC G = 100 Mv/m | $Q_d$ = 8.4 nC G = 150 Mv/m | $Q_d$ = 16.8 nC G = 100 Mv/m | $Q_d$ = 16.8 nC G = 150 Mv/m | $Q_d$ = 33.6 nC G = 100 Mv/m | $Q_d$ = 33.6 nC G = 150 Mv/m |
|---|---|---|---|---|---|---|
| Three Mode Cavity, h = 10 mm, $f_1$ = 3 GHz, $f_2$ = 9 GHz, $f_3$ = 15 GHz | | | | | | |
| $I_{drive}$ | 25.2 A | 25.2 A | 50.4 A | 50.4 A | 100.8 A | 100.8 A |
| $I_{acc}$ | 1.2 A | 1.2 A | 1.2 A | 1.2 A | 1.2 A | 1.2 A |
| Transformer ratio $\chi$ | 7.12 | 5.31 | 14.07 | 10.67 | 28.3 | 21.27 |
| Efficiency | 33.8% | 25.2% | 33.4% | 25.3% | 33.6% | 25.2% |
| E_max | 146 MV/m | 220 MV/m | 146 MV/m | 220 MV/m | 146 MV/m | 220 MV/m |
| $df_1/f_1$ | 8.67E−4 | 5.837E−4 | 1.770E−3 | 1.168E−3 | 3.579E−3 | 2.339E−3 |
| $df_2/f_2$ | −3.362E−4 | −2.168E−4 | −6.345E−4 | −4.338E−4 | −1.238E−3 | −8.353E−4 |
| $df_3/f_3$ | 7.340E−4 | 4.603E−4 | 1.670E−4 | 1.035E−3 | 2.944E−3 | 2.038E−3 |

Where G is the accelerating gradient, $Q_d$ is the charge of the drive bunch, $I_{drive}$ is the drive current, $I_{ace}$ is the accelerated current, $Q_{acc}$ is the charge of the accelerated bunch, $\chi$ is the Transformer ratio, the Efficiency measures the transfer of energy from the drive beam to the accelerated beam, E_max is the maximum electric field that occurs in any position within the cavity, and $df_1/f_1$ measures the proportional detuning.

As shown for these specific examples, the efficiency is at or above the range for CLIC. Thus, aspects in accordance with the present invention, whether configured as a single mode, dual mode, or triple mode cavity match or exceed the CLIC efficiency. Thus, while a triple mode cavity may provide an additional reduction in the amount of exposure time, even the single mode cavity provides the necessary efficiency along with a significant reduction in exposure to the highest electric fields. Likewise, the transformer ratio at $Q_d$=33.6 nC, G=100 Mv/m is comparable to or better than that for CLIC.

It may appear to be a concern that the two beams traveling in nearby channels will result in wakefields from one of the beams upsetting the other beam, causing the beam to veer off path. However, there is sufficient dilution of the short-range transverse wake from the drive beam such that the transverse wake of the drive beam does not significantly affect the accelerated beam in a negative manner, as discussed in further detail in "Two-Beam, Multi-Mode Detuned Accelerating Structure" by S. Yu. Kazakov, S. V. Kuzikov, V. P. Yakolev, and J. L. Hirshfield, 2009 American Institute of Physics 978-0-7354-0617-0/09, Advanced Accelerator Concepts 13$^{th}$ Workshop, pages 439-444.

Although reference is made to CLIC, aspects in accordance with the present invention may be applied to particle accelerators beyond those used in colliders. For example, the acceleration of particle beams may also be used in medical therapy and even nuclear energy. The generation of intense proton beams can be used for practical purposes, not just for research. For example, the energy from an electron beam might be placed into a proton beam in order to apply the proton beam to practical use beyond collisions for scientific research. Proton beams may be applied as part of proton therapy for cancer, a proton driver for a subcritical nuclear reactor, or for a reactor that disposes of nuclear waste. As another exemplary illustration, the generation of intense particle beams or intense short x-rays may be used for tailoring molecules or for altering gene structure. For example a high-quality electron beam may be created for such purposes using aspects in accordance with the present invention.

In addition, the describe aspects are not limited to a certain type of particle acceleration. The concepts are equally applicable to the acceleration of protons, electrons, etc.

Moreover, the term "or" is intended to mean an inclusive "or" rather than an exclusive "or," unless specified otherwise, or clear from the context. In addition, the articles "a" and "an" as used in this application and the appended claims should generally be construed to mean "one or more" unless specified otherwise or clear from the context to be directed to a singular form.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

What is claimed is:

1. A two-beam accelerator device comprising:

a drive beam source for providing a drive beam;

an accelerated beam source for providing an accelerated beam parallel to the drive beam; and a detuned, harmonic cavity disposed in a path of the drive beam and the accelerated beam, the surfaces of the cavity being perpendicular to the path of the drive beam and the accelerated beam having at least one opening at the entrance and exit locations where the drive beam and the accelerated beam, respectively pass through the surfaces, wherein the drive beam and the accelerated beam are co-linear beams that pass through the detuned, harmonic cavity, and wherein the detuned, harmonic cavity comprises an axisymmetric cavity having an opening at each side of the cavity in the surfaces perpendicular to the path of the drive beam and the accelerated beam.

2. The two-beam accelerator device according to claim 1, wherein the detuned, harmonic cavity has a modified pill box shape with planar walls having a sinusoidal profile.

3. The two-beam accelerator device according to claim 1, wherein the cavity is a six sided resonant cavity, the surfaces of the cavity perpendicular to a path of the drive beam and the accelerated beam being rectangular and having a first and a second opening at the location where the drive beam and the accelerated beam, respectively intersect the surfaces, wherein the centers of the first and second openings are spaced a distance 2d from each other in a width direction, wherein d is ¼ the width of the surfaces, and a distance d from the closest side wall in a length direction and are equally spaced between the side walls in a height direction.

4. The two-beam accelerator device according to claim 1, wherein the drive beam has a drive beam voltage approximately 90° out of phase with a drive beam current, and the accelerated beam has an accelerated beam current approximately in phase with the drive beam voltage and an accelerated beam voltage approximately 180° out of phase with the drive beam current.

5. The two-beam accelerator device according to claim 1, wherein the detuned, harmonic cavity comprises a six sided resonant cavity, the surfaces of the cavity perpendicular to a path of the drive beam and the accelerated beam being rectangular, wherein the width and height of the surfaces of the resonant cavity perpendicular to the path of the drive beam and the accelerated beam have a ratio of 2:1.

6. The two-beam accelerator device according to claim 1, wherein the detuned, harmonic cavity comprises a six sided resonant cavity, the surfaces of the cavity perpendicular to a path of the drive beam and the accelerated beam being rectangular, wherein the width and height the surfaces of the resonant cavity perpendicular to the path of the drive beam and the accelerated beam have a ratio of 2.582:1.

7. The two-beam accelerator device according to claim 1, wherein the detuned, harmonic comprises walls having a width between 2-4 mm.

8. The two-beam accelerator device according to claim 1, wherein the detuned, harmonic cavity comprises a metal.

9. The two-beam accelerator device according to claim 1, wherein the detuned, harmonic cavity comprises copper.

10. The two-beam accelerator device according to claim 1, further comprising a set of cavities including a plurality of adjacent resonant cavities.

11. The two-beam accelerator device according to claim 10, wherein each resonant cavity comprises multiple pieces that combine to form the cavity.

12. The two-beam accelerator device according to claim 11, further comprising an external device surrounding the set of resonant cavities for holding the pieces of each cavity together to form the cavity and for maintaining the position of the resonant cavities with respect to one another.

13. The two-beam accelerator device according to claim 12, further comprising:

a pumping manifold surrounding the external device.

14. The two-beam accelerator device according to claim 1, wherein the dimension of the cavity that is parallel to the direction of travel of the two beams minimizes $I_2$ and $I_3$, where G is an acceleration gradient for the resonant cavity, E is the peak electric field for the resonant cavity, t is time, and T is the effective pulse width, wherein $I_2=\int_0^T E^2 dt/G^2T$ and wherein $I_3=\int_0^T E^3 dt/G^3T$.

15. The two-beam accelerator device according to claim 1, wherein the drive beam travels in the same direction as the accelerated beam.

16. The two-beam accelerator device according to claim 1, wherein the drive beam travels in a direction opposite from the direction of the accelerated beam.

17. The two-beam accelerator device according to claim 1, further comprising:

a focusing device.

18. The two-beam accelerator device according to claim 17, wherein the focusing device comprises a modified quadrupole magnet having four magnets, a central passage in the center of the four magnets, and an opening in one of the magnets, wherein the opening includes a channel lined with a magnetic material.

19. A method of accelerating a particle beam, the method comprising:

providing a drive beam;

providing an accelerated beam parallel to the drive beam; and passing the drive beam and the accelerated beam through a detuned, harmonic cavity disposed in a path of the drive beam and the accelerated beam, the surfaces of the cavity perpendicular to the path of the drive beam and the accelerated beam having at least one opening on each side of the cavity at the locations where the drive beam and the accelerated beam, respectively pass through the surfaces, wherein the detuned cavity is an axisymmetric cavity and the drive beam and the accelerated beam are co-linear, the cavity having one opening at each side of the cavity in the surfaces perpendicular to the path of the drive beam and the accelerated beam.

20. The method according to claim 19, wherein the detuned, harmonic cavity has a modified pill box shape with planar walls having a sinusoidal profile.

21. The method of claim 19, wherein the cavity is a six sided resonant cavity disposed in the path of the drive beam and the accelerated beam, the surfaces of the cavity perpendicular to a path of the drive beam and the accelerated beam being rectangular and having a first and a second opening at the location where the drive beam and the accelerated beam, respectively pass through openings in the surfaces, wherein the centers of the first and second openings are spaced a distance 2d from each other in a width direction, wherein d is ¼ the width of the surfaces, and a distance d from the closest side wall in a width direction and are equally spaced between the side walls in a height direction.

22. The method of claim 19, wherein the drive beam has a drive beam voltage approximately 90° out of phase with a drive beam current, and the accelerated beam has an accelerated beam current approximately in phase with the drive beam voltage and an accelerated beam voltage approximately 180° out of phase with the drive beam current.

23. The method of claim 19, further comprising:

passing the drive beam and the accelerated beam through cavity set comprising a plurality of resonant cavities disposed adjacent to one another.

24. The method of claim 19, further comprising:

passing the drive beam and accelerated beam through a focusing device.

25. The method of claim 24, wherein the focusing device includes a modified quadrupole magnet having an opening in one of four magnets, the opening including a channel lined with a magnetic material, the method further comprising:

passing one of the drive beam and the accelerated beam through the center of the quadrupole magnet and passing the other of the drive beam and the accelerated beam through the lined channel in the opening in the magnet.

26. The method of claim 25, further comprising:

passing the drive beam and the accelerated beam through a second focusing device.

27. The method of claim 26, wherein the focusing device includes a second modified quadrupole magnet having an opening in one of its four magnets, the opening including a second channel lined with a magnetic material, the method further comprising:

passing the other of the drive beam and the accelerated beam through the center of the second quadrupole magnet and passing the drive beam or the accelerated beam through the second lined channel in the opening in the magnet of the second modified quadrupole magnet.

28. The method of claim 19, further comprising driving the drive beam and the accelerated beam in the same direction.

29. The method of claim 19, further comprising driving the drive beam and the accelerated beam in opposite directions.

30. The method of claim 19, further comprising reducing a fill time by driving a pre-pulse drive beam current being phase locked with the drive beam.

31. The method of claim 19, further comprising reducing a fill time by modifying at least one of an amplitude and a phase of a beam profile for the drive beam.

* * * * *